US006159677A

United States Patent [19]

Haraguchi

[11] Patent Number: 6,159,677

[45] Date of Patent: Dec. 12, 2000

[54] SILVER HALIDE EMULSION AND SILVER HALIDE COLOR LIGHTSENSITIVE MATERIAL INCLUDING THE SAME

[75] Inventor: Nobuyuki Haraguchi, Minami-Ashigara, Japan

[73] Assignee: Fuji Photo Film, Co., Ltd., Kanagawa, Japan

[21] Appl. No.: 09/086,409

[22] Filed: May 29, 1998

[30] Foreign Application Priority Data

May 29, 1997 [JP] Japan ..... 9-154382

[51] Int. Cl.[7] ..... G03C 1/035; G03C 1/015; G03C 1/04; G03C 1/06

[52] U.S. Cl. ..... 430/567; 430/569; 430/599; 430/603; 430/605

[58] Field of Search ..... 430/567, 569, 430/603, 605, 599

[56] References Cited

U.S. PATENT DOCUMENTS

| | | | |
|---|---|---|---|
| 4,063,951 | 12/1977 | Bogg | 430/567 |
| 4,386,156 | 5/1983 | Mignot | 430/567 |
| 5,320,938 | 6/1994 | House et al. | 430/567 |
| 5,565,314 | 10/1996 | Nakatsu et al. | 430/567 |
| 5,726,006 | 3/1998 | Gourlaouen et al. | 430/567 |
| 5,807,665 | 9/1998 | Saitou | 430/569 |
| 5,879,873 | 3/1999 | Gourlaouen et al. | 430/569 |

*Primary Examiner*—Mark F. Huff
*Attorney, Agent, or Firm*—Birch, Stewart, Kolasch & Birch, LLP.

[57] ABSTRACT

A monodispersed silver halide emulsion has an average silver iodide content of 1 to 20 mol %, an average equivalent sphere diameter of 0.1 to 0.6 $\mu$m, and 60% or more of the total projected area of all the grains in the emulsion are occupied by tabular silver halide grains each having principal planes composed of {100} faces in an amount of 80% or more based on the total surface area of each grain.

12 Claims, 1 Drawing Sheet

SILVER HALIDE EMULSION AND SILVER HALIDE COLOR LIGHTSENSITIVE MATERIAL INCLUDING THE SAME

BACKGROUND OF THE INVENTION

The present invention relates to grains of silver halide (hereinafter silver halide is also referred to as "AgX") which are useful in the field of photography and relates to a photographic lightsensitive material including the same. More particularly, the present invention relates to silver halide grains which are excellent in the ratio of sensitivity/granularity and relates to a photographic lightsensitive material including the same.

Highly sensitive color lightsensitive materials are required for photographing special scenes, such as those of sports needing a high shutter speed and those of stages where the amount of light cannot meet the requirement for exposure, in the field of color photographic lightsensitive materials, especially, color reversal lightsensitive materials often used by professional photographers. The highly sensitive color photographic lightsensitive materials, however, generally have poor graininess (coarse), so that an improvement in the sensitivity/graininess relationship is demanded.

Various methods are available for enhancing the sensitivity of the silver halide emulsion, which include, for example, method (1) in which the number of photons absorbed by each of the grains is increased, method (2) in which the efficiency of conversion of photoelectrons generated by light absorption into silver cluster (latent image) is enhanced and method (3) in which a development activity is enhanced for effective utilization of the formed latent image.

In line with the method (1) out of the above methods, tabular AgX grains having twin planes parallel to each other, having principal planes composed of {111} faces and having a high aspect ratio (projected circle equivalent diameter/thickness) have become frequently used in the photographic lightsensitive materials because, as compared with the non-tabular AgX grains, the proportion of incident light which passes through the lightsensitive layer without being absorbed is reduced to thereby enable enhancing a light capturing efficiency and because improvement can be attained in image quality (covering power, sharpness and graininess), rate of development, spectral sensitization characteristics, etc.

Although the sensitivity/granularity ratio of employed emulsion must be further raised for further enhancing the image quality of photographic lightsensitive materials, the situation has been encountered such that, with the use of tabular grains having principal planes composed of {111} faces, the sensitivity increase is limited to thereby disenable attaining the object.

In this situation, the inventor has decided to study on tabular grains each having principal planes composed of {100} faces. Because, as compared with {111} faces, almost all of which are composed of halide ions (hereinafter a halide ion is also referred to as "$X^-$"), grains having {100} faces, each of which composed of alternately arranged $Ag^+$ and $X^-$, are presumed to exhibit less desensitization in the case where a spectral sensitizing dye is adsorbed thereto and may promise enhanced photographic performance, and are thus attracting attention in recent years.

With respect to the preparation of these {100} tabular grains, the preparation of silver bromide {100} tabular grains is described in U.S. Pat. Nos. 4,063,951 and 4,386,156. However, the ultimate use of the grains prepared by the methods of these patents in photographic lightsensitive materials resulted in unsatisfactory performance, especially, in respect of the photographic sensitivity. In efforts to attain further performance enhancement, Jpn. Pat. Appln. KOKAI Publication No. (hereinafter referred to as JP-A-) 6-19028 discloses a process for preparing silver iodobromide {100} tabular grains which contain {100} tabular grains in an amount of at least 50% based on the total projected area of all grains and which exhibit an intragranular average silver iodide content of at least 1 mol %. This process has infallibly enabled obtaining {100} tabular grains which exhibit enhanced performance as compared with that of the grains described in the prior patents. However, the performance of the {100} tabular grains is still unsatisfactory for use in the high-image-quality photographic lightsensitive materials of recent years. In particular, the performance in small-size region of the {100} tabular grains is inferior to that of the conventional {111} tabular emulsion. For example, in the use in the color reversal photographic lightsensitive material whose performance is conspicuously affected by the emulsion performance in small-size region, the {100} tabular grains leave room for performance enhancement in attainments of high sensitivity and high contrast, etc.

BRIEF SUMMARY OF THE INVENTION

In these circumstances, the inventor has conducted further studies with a view toward developing small-size {100} tabular grains which excel the conventional small-size {111} tabular grains in performance. As a result, it has been found that, only when the small-size {100} tabular grains have the characteristics defined in the present invention, they can excel the conventional small-size {111} tabular grains in performance and that the use thereof in photographic lightsensitive materials enables attaining striking performance enhancement. Moreover, it has surprisingly been found that the above {100} tabular grains are highly excellent in latent image preservation as compared with the conventional grains.

Therefore, it is an object of the present invention to provide a small-size AgX emulsion which is excellent in not only sensitivity/granularity ratio but also high contrast and latent image preservation, and to provide a silver halide color photographic lightsensitive material including the small-size AgX emulsion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the preferred embodiments given below, serve to explain the principles of the invention.

DETAILED DESCRIPTION OF THE INVENTION

Figure 1:
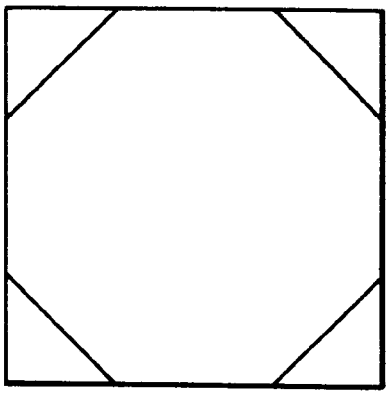
FIG. 1 is a top view of tetradecahedral AgX grains.

The object of the present invention has been attained by:

(1) A monodispersed silver halide emulsion having an average silver iodide content of 1 to 20 mol % and an average equivalent sphere diameter of 0.1 to 0.6 μm, wherein 60% or more of the total projected area of all the grains in the emulsion are occupied by tabular silver halide grains each having principal planes composed of {100} faces in an amount of 80% or more based on the total surface area of each grain;

(2) A monodispersed silver halide emulsion having an average silver iodide content of 1 to 10 mol % and an average equivalent sphere diameter of 0.1 to 0.5 μm, wherein 60% or more of the total projected area of all the grains in the emulsion are occupied by tabular silver halide grains each having principal planes composed of {100} faces in an amount of 80% or more based on the total surface area of each grain; and (3) The emulsion as recited in item (1) or (2) above, wherein the emulsion was produced in the presence of a compound $A^0$ and/or compound $B^0$, wherein the compound $A^0$ is an organic compound constructed of a molecule and covalently bonded at least two redidual groups of adsorbent thereto, wherein the adsorbent is capable of promoting formation of {100} faces in each silver halide grain, the compound $B^0$ is an organic compound having at least two alcoholic hydroxy groups per molecule, and the compound $A^0$ and compound $B^0$ are organic compounds other than gelatin and protein;

(4) A silver halide color photographic lightsensitive material comprising a support and, provided thereon, at least one lightsensitive layer, wherein the lightsensitive layer contains the monodispersed silver halide emulsion of any one of items (1) to (3) above; and (5) The silver halide color photographic lightsensitive material as recited in item (4) above, wherein the material is a silver halide color reversal photographic lightsensitive material.

The present invention will now be described in greater detail.

(A) AgX Emulsion:

The average equivalent sphere diameter of AgX grains contained in the AgX emulsion of the present invention ranges from 0.1 to 0.6 μm, preferably, from 0.1 to 0.5 μm. Although the halogen composition is not particularly limited, at least the average $I^-$ content of 1 to 20 mol %, preferably, 1 to 10 mol % is satisfied. It is preferred that the average silver chloride content of the emulsion is 0 to 10 mol %. The halogen composition other than $I^-$ preferably includes at least one of $Br^-$ and $Cl^-$. When $Br^-$ and $Cl^-$ are contained in addition to $I^-$, it is preferred that $Cl^-$<10 mol %, and it is more preferred that $Cl^-$ be 0 mol %. The average halide content of the emulsion herein means the average value of the halide content of arbitrarily collected approximately 300 or more silver halide grains in the emulsion.

The AgX emulsion of the present invention contains tabular grains having principal planes composed of {100} faces and preferably having an aspect ratio of 2 to 100, more preferably, 3 to 50 and, much more preferably, 6 to 50 in an amount of at least 60%, preferably, at least 80% and, more preferably, at least 90% based on the total projected area.

A tabular grain is composed of mutually parallel two principal planes and edge faces connecting the principal planes.

The term "aspect ratio" used herein means a ratio of a projected diameter to a thickness of a grain. The projected diameter means the diameter of a circle having the same area as the projected area of the grain, and the thickness means the spacing between two principal planes of the tabular grain. The projected diameter of tabular grains means the diameter of a circle having the same area as the projected area as obtained by arranging the principal planes in parallel to the base surface and observing in the direction vertical thereto. The term "equivalent sphere diameter" used herein means the diameter of a sphere having the same volume as that of the grain. The average equivalent sphere diameter herein means the average value of the equivalent sphere diameters of arbitrarily collected approximately 300 or more silver halide grains in the emulsion.

The AgX grains contained in the AgX emulsion of the present invention are monodispersed. The term "monodispersed" used herein means that the variation coefficient of the equivalent sphere diameter distribution is preferably up to 25%, more preferably, up to 20%.

The tabular grains having principal planes composed of {100} faces can be configurationally classified into six groups as follows:

(1) grains whose principal planes have the shape of a right angled parallelogram, in which the length to width ratio (dimension of long side/dimension of short side) of each grain ranges from 1 to 10, preferably, from 1 to 3 and, more preferably, from 1 to 2, (2) grains whose principal planes have the shape of the right angled parallelogram, in which at least one, preferably, one to three of the four corners of the right angled parallelogram are nonequivalently deleted [that is, (area of the largest deleted part)/(area of the smallest deleted part)=K1 ranging from 2 to ∞], (3) grains which are the same as (2) above except that the four corners of the right angled parallelogram are equivalently deleted (that is, the value of K1 being smaller than 2), (4) grains which are the same as (3) above except that 5 to 100%, preferably, 20 to 100% of the area of edge faces of the deleted parts composed of {111} faces, (5) grains in which among four sides defining the principal plane, at least two opposite sides thereof are in a form of outward protrudent curves, and (6) grains which are the same as (2) above except that at least one, preferably, one to three of the four corners of the right angled parallelogram are deleted in the form of a right angled parallelogram.

Furthermore, there can be mentioned grains in which 1 to 100%, preferably, 5 to 50% of the area of edge faces of the tabular grains consists of {n10} faces, wherein n=1 to 5, preferably, 1.

With respect to the intragranular halogen composition structure, there can be mentioned grains (1) of the homogeneous structure type and grains (2) with the core/shell structure in which the core and the shell have different halogen compositions. The AgX molar ratio of the core/shell, although not particularly limited, preferably ranges from $10^{-5}$ to $10^5$, more preferably, from $10^{-3}$ to $10^3$ and, most preferably, from $10^{-2}$ to $10^2$. Further, there can be mentioned multiple structure grains having a core and at least two shell layers. With respect to the granular structure of these grains, reference can be made to JP-A-5-281640 and JP-A-6-59360, the disclosures of which are incorporated by reference. The halogen compositions of individual layers are preferably different from each other by 1 to 100 mol %, more preferably, by 3 to 90 mol % and, most preferably, by 10 to 80 mol % in respect of $Cl^-$ content or $Br^-$ content. In respect of $I^-$ content, the halogen compositions of individual layers are preferably different from each other by 0.5 to 40 mol %, more preferably, by 3 to 20 mol %. Also, the grain surface can be covered with different AgX layers (AgCl, AgBr, AgI and mixed crystals consisting of at least two members thereof in unlimited proportion) in an amount of 0.1 to 100 atomic layers, preferably, 0.5 to 30 atomic layers.

In the present invention, the content of grains satisfying the relationship: length to width ratio ≧7 and/or crystal grains consisting of at least two grains of such a configuration as above combined together at right angles or in parallel to each other, is in the range of 0 to 20% by weight, preferably, 0% by weight based on the total AgX.

Still further, there can be mentioned a form of grains having a surface layer whose $SCN^-$ content or $I^-$ content is 0.1 mol % or more, preferably, in the range of 0.5 to 50 mol %. Moreover, there can be mentioned another form of grains having a surface layer whose $Br^-$ content is in the range of 1 to 100 mol %, preferably, 5 to 80 mol %. The term "surface layer of grains" used herein means a portion of 1 to 1000 atomic layers, preferably, 1 to 3 atomic layers counted from the extreme surface. It is preferred that the above contents and surface layer thickness be distributed substantially uniformly throughout the grain surface and among the individual grains.

The term "substantially uniform" used herein means that each of the variation coefficients (standard deviation/average content) of the content distribution and the surface layer thickness distribution falls preferably within the range of 0 to 0.4, more preferably, 0 to 0.2 and, most preferably, 0 to 0.1.

Furthermore, there can be mentioned a form of grains having a nonuniformly distributed grain surface (variation coefficient ≧0.4). Especially, there can be mentioned a form having grain edge parts or corner parts and vicinity thereof rendered protrudent. For example, reference can be made to U.S. Pat. No. 5,275,930, the disclosure of which is herein incorporated by reference.

The ratio of the total area of {100} faces of each grain to the total surface area of each grains is preferably at least 80%, more preferably, at least 90%. A statistical estimation of the ratio can be performed by the use of an electron micrograph of grains.

When the {100} tabular face ratio of each silver halide grain of the emulsion is nearly 100%, the above estimate can be confirmed by the following method. The method is described in Journal of the Chemical Society of Japan, No. 6, p942, (1984), the disclosure of which is herein incorporated by reference. The method comprises causing a given amount of tabular grains to adsorb varied amounts of benzothiacyanine dye at 40° C. for 17 hr, determining the sum total (S) of surface areas of all grains and the sum total (S1) of areas of {100} faces per unit emulsion from the light absorption at 625 nm and calculating the {100} face ratio by applying these sum total values to the formula: (S1/S)×100 (%).

The compounds $A^0$ and $B^0$ will now be described.

(B) Compounds $A^0$ and $B^0$:

(I) Compound $A^0$ will be Described in Detail Below:

The compound $A^0$ is preferably represented by the general formula (1):

$$—(A)a—(B)b— \quad (1)$$

wherein a and b represent the weight percentages of respective components, so that a+b=100.

The compound $A^0$ is an organic compound having, per molecule, at least two, preferably, 4 to $10^3$, more preferably, 8 to 100 and, most preferably, 20 to 100 redidual groups of covalently bonded adsorbent $C^0$ capable of promoting formation of {100} faces of the silver halide grains. The compound $A^0$ refers to a compound having the following characteristics under the conditions of the experiments set forth below:

First, regular crystal silver halide emulsion grains having an average diameter of approximately 0.2 μm are formed in the presence of conventional photographic gelatin. An equal amount of samples each containing the regular crystal AgX grains in a number of $N^0$ are taken as seed crystals from the emulsion. One of the samples is put in an aqueous solution of conventional photographic gelatin dispersion medium, and $Ag^+$ and $Br^-$ are added by a double jet method at 60° C. while maintaining the silver potential at a constant value, thereby growing the seed crystal to an average diameter of approximately 1.0 μm without rendering any new nuclei being formed. The same experiments as above are conducted, except that the silver potential is varied to thereby determine the relationship of silver potential versus grain configuration. On the other hand, the compound $A^0$ having covalently bonded redidual groups of adsorbent $C^0$ as mentioned above is added in an amount corresponding to 30% by weight of the weight of gelatin contained in the above aqueous solution, and the same experiments are conducted to thereby determine the relationship of silver potential versus grain configuration. The gelatin content of the aqueous solution at the initiation of grain growth is 18 g/liter (hereinafter liter is referred to as "L"). The addition amount of $Ag^+$ is 70 g in terms of $AgNO_3$. The pH is a constant value over the pKa value of $A^0$, preferably, (pKa value+0.5). Herein, the pKa value is an acid dissociation constant value. The silver potential is the potential of silver rod against calomel electrode saturated at room temperature. With respect to the silver potential, an AgBr electrode, an AgI electrode, an $Ag_2S$ electrode or a mixed crystal electrode composed of at least two members selected from among these can be used in place of the silver rod. In any case, however, the comparative experiments between with and without the compound $A^0$ are performed under the same conditions, except that the compound $A^0$ is added on the one hand and is not added on the other hand.

As a result of the comparative experiments, such a relationship is recognized that, in the latter instance (compound $A^0$ having covalently bonded redidual groups of $C^0$ is added), the silver potential at which tetradecahedral grains of the identical configuration can be obtained, shifts toward a lower potential side by at least 10 mV, preferably, 20 to 150 mV, more preferably, 30 to 120 mV and, most preferably, 50 to 100 mV, relative to the gelatin system in which no compound $A^0$ is added. When such a potential shift toward the lower side is realized by causing a certain compound to be present in a certain amount, the amount of potential shift is referred to as the "amount of equilibrium crystal habit potential shift" in the present invention. The tetradecahedral grains are preferably those corresponding to cubic grains having each of the corners deleted by an average of 30% of each side length, and the plan view of the tetradecahedral grains is given in FIG. 1. Regarding other details of the measurement of silver potential, reference can be made to "Ion Selective Electrode" translated by Shin Munemori, et al. and published by Kyoritsu Shuppan Co., Ltd. (1977) and chapter 5 of "Denki Kagaku Binran (Electrochemical Manual)" published by Maruzen Co., Ltd. (1985), the disclosures of which are herein incorporated by reference.

The adsorbent $C^0$ is an organic compound having at least one nitrogen atom, N, which has a π electron pair stabilized by resonance. As examples of the adsorbent $C^0$, heterocyclic compounds containing N in the ring can firstly be mentioned. Examples thereof include saturated or unsaturated heterocycles containing only one N atom in the ring as a heteroatom, which may be substituted (e.g., pyridine, indole, pyrrolidine and quinoline) and saturated or unsaturated heterocycles containing one N atom and at least one heteroatom selected from the group consisting of N and O in the ring, which may be substituted (e.g., imidazoline, imidazole, pyrazole, oxazole, piperazine, triazole, tetrazole, oxadiazole, oxatriazole, dioxazole, pyrimidine, pyrimidazole, pyrazine, triazine, tetrazine and benzimidazole).

Secondly, organic compounds having a N atom to which an aromatic ring is substituted, represented by the formula (2) given below, can be mentioned as the adsorbent $C^0$. In the formula, Ar represents an aromatic ring that is composed with 5 to 14 carbon atoms, preferably, an aromatic ring composed of a carbon ring. Each of $R^1$ and $R^2$ represents H, Ar, an aliphatic group or both $R^1$ and $R^2$ together can form a 5 or 6-membered ring such as aniline, α-naphthylamine, carbazole, 1,8-naphthilidine, nicotine or benzoxazole. For other details, reference can be made to EP 0534395A1 and JP-A-6-19029, the disclosure of which are herein incorporated by reference. Of these compounds, imidazole and benzimidazole are preferred.

(2)

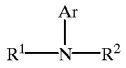

The compound $A^0$ can be produced by polymerizing at least two molecules of polymerizable ethylenically unsaturated monomer represented by the formula (3) given below or by copolymerizing at least one of the same with at least one polymerizable ethylenically unsaturated monomer represented by the formula (4) given below. In the compound $A^0$, the plural repeating units derived from monomers represented by the formula (3) may be a single species or a mixture of a plurality of species. Similarly, the plural repeating units derived from monomers represented by the formula (4) may be a single species or a mixture of a plurality of species. Copolymerization may be conducted in a proportion satisfying the above mode.

In the formula (3), $c^1$ represents a residue resulting from the bonding of the adsorbent $C^0$ to the monomer. In the formula (4), $d^1$ represents a functional group. The compound of the formula (4) undergoes the above polymerization to thereby form the portion B of the general formula (1) given before and the portion E of the general formula (5) given later.

(3)

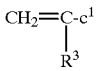

(4)

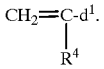

In the formulae (4) and (5) above, each of $R^3$ and $R^4$ represents a hydrogen atom or an alkyl group having 1 to 10 carbon atoms, preferably, 1 to 5 carbon atoms. The alkyl group may be unsubstituted or substituted. In the case where the alkyl group is substituted, the number of carbon atoms mentioned above includes the carbon atom of the substituent.

Examples of the compounds represented by the formula (3) include monomers having a heterocyclic group containing a basic nitrogen atom, such as vinylimidazole, 2-methyl-1-vinylimidazole, 4-vinylpyridine, 2-vinylpyridine, N-vinylcarbazole, 4-acrylamidopyridine, N-acryloylimidazole, N-2-acryloyloxyethylimidazole, 4-N-(2-acryloyloxyethyl)aminopyridine, 1-vinylbenzimidazole, N-vinylbenzylimidazole, N-methacryloyloxyethylpyrrolidine, N-acryloylpiperadine, 1-vinyltriazole, 3,5-dimethyl-1-vinylpyrazole, N-methacryloyloxyethylmorpholine, N-vinylbenzylpiperidine and N-vinylbenzylmorpholine.

It is preferred that the copolymerizable ethylenically unsaturated monomer capable of forming B in the formula (1) above is one whose homopolymer is soluble in one of acidic, neutral and alkaline aqueous solutions. Suitable compound examples thereof include nonionic monomers such as acrylamide, methacrylamide, N-methylacrylamide, N,N-dimethylacrylamide, N-acryloylmorpholine, N-ethylacrylamide, diacetonacrylamide, N-vinylpyrrolidone and N-vinylacetamide; anionic group-having monomers such as acrylic acid, methacrylic acid, itaconic acid, vinylbenzoic acid, styrenesulfonic acid, styrenesulfinic acid, phosphonoxyethyl acrylate, phosphonoxyethyl methacrylate, 2-acrylamido-2-methylpropanesulfonic acid and 3-acrylamidopropionic acid or salts thereof; and cationic group-having monomers such as N,N,N-trimethyl-N-vinylbenzylammonium chloride and N,N,N-trimethyl-N-3-acrylamidopropylammonium chloride.

In the formula (1) above, B is a copolymer of at least one monomer selected from among the above. Another hydrophobic ethylenically unsaturated monomer can be copolymerized into B in an amount not detrimental to the water solubility of the entire molecule of the formula (1).

The other hydrophobic ethylenically unsaturated monomer is selected from among, for example, ethylene, propylene, 1-butene, styrene, α-methylstyrene, methyl vinyl ketone, monoethylenically unsaturated esters of fatty acids (e.g., vinyl acetate and allyl acetate), esters of ethylenically unsaturated monocarboxylic or dicarboxylic acid (e.g., methacrylic acid esters), amides of ethylenically unsaturated monocarboxylic acid (e.g., t-butylacrylamide), monoethylenically unsaturated compounds (e.g., acrylonitrile and methacrylonitrile) and dienes (e.g., butadiene and isoprene).

In the formula (1), a is in the range of (0.002 to 1.0)×100, preferably, (0.01 to 0.8)×100, more preferably, (0.05 to 0.7)×100 and, much more preferably, (0.15 to 0.6)×100. The molecular weight of the compound $A^0$ ranges from 150 to $10^6$, preferably, 300 to $3\times10^5$ and, more preferably, $10^3$ to $3\times10^5$.

With respect to the chemical bond combining $c^1$ and the ethylenically unsaturated monomer in the formula (3), a divalent connecting group L may be interposed as in $H_2C{=}C(H)—L—c^1$, as well as is in a mode of direct bonding as in the formula (3) described above. For example, $H_2C{=}C(H)—CONH—c^1$ and $H_2C{=}C(H)—COO—c^1$ can be mentioned as modes of indirect bonding. For details of the divalent connecting group and the bonding mode thereof, reference can be made to the description of JP-A-3-109539 and JP-A-4-226449, the disclosure of which are herein incorporated by reference.

The compound $A^0$ is more generally a polymer of at least two, preferably, 4 to $10^3$, more preferably, 8 to 100 and, much more preferably, 20 to 100 residual groups of polymerizable monomers each having a $c^1$ group. The compound $A^0$ can be obtained by polymerizing the polymerizable monomer having a $c^1$ group or by bonding $c^1$ groups to an already existing polymer.

The polymerization method can be any of the addition polymerization, condensation polymerization, polyaddition polymerization, ring-opening polymerization and addition condensation methods. The addition polymerization of a vinyl compound, a vinylidene compound or a diene compound is preferred, and the addition polymerization of a vinyl compound is especially preferred. For details thereof, reference can be made to Shin Jikken Kagaku Koza (New Experimental Chemistry Course) 19, Kobunshi Kagaku (Polymer Chemistry) [I], Maruzen Co., Ltd. (1978) and the 4th edition of Jikken Kagaku Koza (Experimental Chemistry Course) 28, 29, Maruzen Co., Ltd. (1992), the disclosures of which are herein incorporated by reference. The monomer that forms the compound $A^0$ has at least one, preferably, 1 to 3 and, more preferably, one $c^1$ group. The $c^1$ group is not present on the principal chain of the polymer and is bonded thereto as a branch. The compound $A^0$ is preferably a polymer of at least one ethylenically unsaturated monomer, having per molecule thereof at least two, preferably, 4 to $10^3$, more preferably, 8 to 100 and, much more preferably, 20 to 100 imidazole or benzimidazole groups.

(II) Compound $B^0$ will be Described in Detail Below:

The compound $B^0$ is a compound other than gelatin and protein, having a molecular weight of, preferably, at least 90, more preferably, 300 to $10^6$, much more preferably, $10^3$ to $10^5$ and, still much more preferably, 3000 to $10^5$, and containing per molecule thereof at least two, preferably, 4 to $10^5$, more preferably, 10 to $10^4$ and, most preferably, 30 to $10^3$ much more preferably 100 to $10^3$ alcoholic hydroxy groups. Further, the ratio of number of alcoholic hydroxy groups to number of all functional groups (=x1) per molecule is preferably at least 0.05, more preferably, in the range of 0.2 to 1.0, still more preferably, 0.4 to 1.0 and, most preferably, 0.6 to 1.0. The functional group mentioned above is a residue which is more reactive than hydrocarbon residues such as methyl and the like, and refers to a heteroatom group or an atom group containing a heteroatom. Still further, the ratio of total weight of all alcoholic hydroxy groups to total weight of one molecule (=x2) per molecule is in the range of, preferably, 0.01 to 0.6, more preferably, 0.05 to 0.55 and, most preferably, 0.1 to 0.5.

As practical examples of the compound $B^0$, firstly, carbohydrates can be mentioned. Hereinafter the carbohydrates are also referred to as compound 1). The carbohydrates are polysaccharides satisfying the above requirements for molecular weight and include homopolysaccharides composed of a single constituent sugar and heteropolysaccharides composed of a plurality of constituent sugars. Examples of the constituent sugars include monosaccharides of the molecular formula $(CH_2O)_n$ wherein n ranges from 5 to 7, sugar alcohol, aldonic acid having a —COOH group in place of a —CHO group, uronic acid having a $—CH_2OH$ group converted to a —COOH group and amino sugars. The carbohydrates also include sugar derivatives (e.g., viscose, methylcellulose, ethylcellulose, hydroxyethylcellulose, carboxymethylcellulose, soluble starch, carboxymethyl starch, dialdehyde starch and glycosides). The carbohydrates excluding nucleic acids are preferable and the carbohydrates excluding glycosides are more preferable.

Specific examples of the carbohydrates, i.e., compound 1, include starches (cane starch, potato starch, tapioca starch, wheat starch and corn starch), devil's-tongue, glue plant, agar, sodium alginate, Nibicus manihot, tragacanth, gum, gum arabic, dextran, dextrin and levan. Galactose (agar, etc.) is preferably used.

Secondly, polyhydric alcohols can be mentioned as examples of the compounds $B^0$. Hereinafter the polyhydric alcoholes are also referred to as compound 2). These are also called alkane polyols, examples of which include glycerol, glycitol and ethylene glycol.

Thirdly, examples of the compounds $B^0$ include polymers represented by the general formula (5):

$$—(D)d—(E)e— \quad (5)$$

wherein d and e represent the weight percentages of respective components and d+e=100, D represents a repeating unit formed from an ethylenically unsaturated monomer having at least one alcoholic hydroxy group, and E represents a repeating unit other than D, formed from an ethylenically unsaturated monomer. Hereinafter the polymers represents by the general formula (5) is also referred to as compound 3). With respect to the d and e representing the weight percentages of respective components, d ranges from 5 to 100, preferably, 20 to 100 and, more preferably, 40 to 100, and e ranges from 0 to 95, preferably, 0 to 80 and, more preferably, 0 to 60. Examples of the ethylenically unsaturated monomers capable of forming E include the ethylenically unsaturated monomers capable of forming B of the general formula (1) given hereinbefore and the monomers represented by the formula (3) given hereinbefore.

Preferred examples of the compounds 3) include vinyl acetate/polyvinyl alcohol copolymers whose copolymerization ratio can be selected by regulating the degree of saponification of polyvinyl acetate.

The addition amount of compound $B^0$ is the same as that of the compound $A^0$. That is, the compound $B^0$ is added in an amount such that the equilibrium crystal habit potential shifts toward a lower potential side by at least 10 mV, preferably, 20 to 150 mV, more preferably, 30 to 120 mV and, most preferably, 50 to 100 mV relative to the gelatin system.

In the case where both compound $A^0$ and compound $B^0$ are added, the addition amount expressed by the crystal habit potential shift mentioned above is the one that is attained by both of the compounds $A^0$ and $B^0$.

For other details of the compounds represented by the general formulae (1) and (5) and the method of polymerizing the same, reference can be made to, for example, Teiji Tsuruta, revised edition of "Kobunshi Gosei Hanno (Polymer Synthetic Reaction)", Nikkan Kogyo Shimbunsha (1971); Takayuki Otsu, et al. "Kobunshi Gosei no Jikkenho (Experimental Method for Polymer Synthesis)", Kagaku Dozin, pp. 124–154 (1972); JP-A-6-19029; and the literature for water soluble polymers listed below, the disclosures of which are herein incorporated by reference.

With respect to the compounds 1) to 3), at least two species may jointly be used at an appropriately selected ratio. These compounds in powdery or solution form may directly be added to the reaction mixture or may first be dissolved in an acidic, a neutral or an alkaline water and then added to the reaction mixture. For other details of the compounds 1) to 3), reference can be made to "Shin Suiyosei Polymer no Oyo to Shijo (Application and Market of New Water Soluble Polymer)"edited by Shinji Nagatomo, CMC (1988); "Suiyosei Kobunshi/Mizubunsangata Jushi Sogo Gijutsu Shiryoshu (Comprehensive Technical Data Collection on Water Soluble Polymer/Water Dispersible Resin)" edited by Publishing Division of Keiei Kaihatsu Center, Publishing Division of Keiei Kaihatsu Center (1981); new supplemental 3rd edition of "Suiyosei Kobunshi (Water Soluble Polymer)" edited by Tadanori Misawa, Kagaku Kogyosha (1990); and "Polyvinyl Alcohol" edited by C. A. Finch, John Wiley & Sons (1992), the disclosures of which are herein incorporated by reference.

(C) Formation of Tabular Grains Will be Described in Detail Below:

(C)-1. Step of Seed Formation:

The tabular grains have crystal defects enabling preferential growth toward the edges, so that a tabular form is realized. The defects are produced during the formation of seeds for tabular grains. Some methods for forming the defects are, for example, as follows.

1) $Ag^+$ and $X^-$ are added to an aqueous solution containing the compound $A^0$ and/or compound $B^0$. The defects occur when at least one of the compounds is adsorbed on formed AgX nuclei and $Ag^+$ and $X^-$ are laminated onto the nuclei. The defects may also occur when the added $Ag^+$ and $X^-$ cooperate with at least one of the compounds to thereby produce complexes and these complexes are included in the AgX nuclei.

2) First, $AgX^0$ nuclei which substantially do not contain any defects are formed in an aqueous solution of dispersion medium. Subsequently, at least one of the above compound is added so that the compound is adsorbed on the $AgX^0$ nuclei. Then, $Ag^+$ and $X^-$ are added so that these are laminated onto the AgX nuclei to thereby form defects. The term "substantially" means that the amount of defects contained in the $AgX^0$ nuclei is in the range of, preferably, 0 to 20%, more preferably, 0 to 5% and, most preferably, 0 to 1% based on the amount of defects formed at the time of seed formation is finished.

The addition of the above compounds can be performed while adding $Ag^+$ and $X^-$, and also can be performed after the termination of the addition of $Ag^+$ and $X^-$. The addition of the compounds can be followed by further addition of $Ag^+$ and $X^-$ at the temperature unchanged or can be followed by first heating by at least 3° C., preferably, 5 to 70° C. and, more preferably, 10 to 60° C. and subsequent addition of $Ag^+$ and $X^-$ to thereby form the defects. The latter is preferred. The additions can be performed under most desirably selected respective conditions.

3) At the time of forming AgX seeds, at least one gap interface between both sides of which are different in halogen composition is produced in the nuclei and crystal lattice strain is generated to thereby form the defects. For example, $Ag^+$ and $Xa^-$ are added to thereby first produce AgXa nuclei. Subsequently, $Ag^+$ and $Xb^-$ are added to thereby produce (AgXa|AgXb) seeds. In this instance, the composition of $Xa^-$ is different from that of $Xb^-$ by 10 to 100 mol %, preferably, 30 to 100 mol % and, more preferably, 50 to 100 mol % in the $Cl^-$, $Br^-$ or $I^-$ content. Each of the above $Xa^-$ and $Xb^-$ represents the halogen composition of added halogen salt solution. At least one, preferably, 1 to 5 and, more preferably, 2 to 4 gap interfaces are produced in each seed. Another method of forming (AgXa|AgXc) seeds is that after AgXa nuclei is formed, $Xc^-$ only is added, or $Xc^-$ and $Ag^+$ in a molar amount of $Xc^- > Ag^+$, preferably, $Xc^- > 2\ Ag^+$ and, more preferably, $Xc^- > 5\ Ag^+$ are added. This method is preferred. The expression "$Xc^- > 2\ Ag^+$" means that the added molar amount of $Xc^-$ is greater than twice that of $Ag^+$. $Xc^-$ also represents the halogent composition of added salt solution, which may different from that represented by $Xb^-$. The solubility of AgXc is preferably up to 1/1.5, more preferably, up to ⅓ and, most preferably, up to ⅛ of that of AgXa. In this case, a halogen conversion reaction occurs between added Xc and AgXa with the result that (AgXa|AgXb) is formed.

The method of adding $X^-$ may comprise first adding at least one member of $Cl_2$, $Br_2$ and $I_2$ and then adding a reducing agent to thereby produce $X^-$. The above member can be added in the form of any of a gas, an aqueous solution, a solid and an inclusion compound. Further, this addition can be performed by the mode: $X_2 + X^- \rightarrow (X_3)^-$. For example, an aqueous solution of $(I_3)^-$ can be mentioned. As the above reducing agent, use can be made of one capable of providing a standard electrode potential which is negative relative to the standard electrode potential of $X_2$+2 electrons→2 $X^-$ or $X_2$+2 electrons←2 $X^-$. Photographically inert reducing agents are preferably used, which include $H_2SO_3$. The addition can also be performed in the form of a mixed aqueous solution with the above carbohydrate.

Further, $Br^-$ or $I^-$ can be added by the method in which a $Br^-$ or $I^-$ emitting agent is first added to the reaction mixture and then $Br^-$ or $I^-$ is released. With respect to this method, reference can be made to JP-A-6-19029, EP 0561415A and U.S. Pat. No. 5,061,615, the disclosures of which are herein incorporated by reference.

Still further, use can be made of the method in which AgXa nuclei are first produced and AgXb fine grains are added and ripened to thereby form (AgXa|AgXb) halogen composition gap. Xa and Xb are as defined above. AgXb fine grains are those having a grain diameter of 0.15 μm or less, preferably, 0.003 to 0.07 μm and, more preferably, 0.005 to 0.05 μm.

4) Moreover, the defects can be formed by the method in which $I^-$ is incorporated in the aqueous solution of dispersion medium prior to nucleation and/or the method in which, for the addition of $Ag^+$ and $X^-$ at the time of nucleation, the addition of $X^-$ can be performed by the addition of a solution containing $I^-$ and $Cl^-$. In the former method, the addition amount of $I^-$ ranges from $10^{-5}$ to $10^{-1}$ mol/L, preferably, $10^{-4}$ to $10^{-2}$ mol/L. In the latter method, the $I^-$ content is preferably 30 mol % or less, more preferably, in the range of 0.1 to 10 mol %. On the other hand, the $Cl^-$ content is preferably at least 30 mol %, more preferably, at least 50 mol %.

With respect to the defect formation in the above instances, its optimum amount is preferably decided depending on the configuration of finally formed AgX grains. When the amount of defect formation is too small, the proportion of the number of tabular grains to the number of all the AgX grains is unfavorably decreased. On the other hand, when the amount of defect formation is too large, a multiplicity of defects occur in each grain, so that the proportion of the number of grains with low aspect ratio to the number of all the AgX grains is unfavorably increased. Therefore, it is desirable to select a defect formation amount such that the proportion of the projected area of the tabular grains becomes a favorable value. In the methods 1) and 2) above, the greater the addition amount of the above compound, or the lower the gelatin concentration, or the greater the adsorptive strength of the above compound, the greater the amount of defect formation. In the method 3) above, the greater the above gap difference, or the greater the conversion amount, or the greater the addition amount of AgXa or AgXb, the greater the amount of defect formation. In the method 4) above, the greater the $I^-$ content, the greater the amount of defect formation.

In these methods, the amount of defect formation also depends on the pH and $X^-$ concentration of the reaction mixture. Therefore, optimum pH value and $X^-$ concentration can be selected. In the method 3) above, the halogen conversion reaction preferentially occurs at the edge and corner portions of AgXa nuclei, and the defects are preferentially formed there.

Of the methods 1) to 4) above, the methods 1) to 3) are preferred and the methods 1) and 2) are more preferred. The method 2) is most preferred because the method 2) is effective under low pH conditions (pH=1 to 6) as well to thereby ensure advantage in achieving the reduction of the tabular grain thickness. The term "nuclei" used in the present invention means minute AgX grains.

(C)-2. Ripening, Growth Step and Grain Formation Modes According to Present Invention:

The above formation of crystal defect containing seeds is preferably followed by a ripening step. Specifically, Ostwald ripening is carried out by heating up by at least 5° C., preferably, 10 to 70° C. and, more preferably, 20 to 70° C. so that nontabular grains are eliminated and the tabular grains are grown. This ripening can be carried out while adding $Ag^+$ and $X^-$ at a low rate.

The ripening can also be performed at an increased $X^-$ concentration or in a AgX solvent, which is known per se, added to increase the degree of dissolution of AgX. With respect to the pH of the reaction mixture during the ripening, an appropriate value can be selected within the range of 1 to 11, preferably, 1.7 to 9. The addition amount of the AgX solvent ranges from 0 to $10^{-1}$ mol/L, preferably, 0 to $10^{-3}$ mol/L, and, after the ripening, the AgX solvent can be deactivated. For example, the deactivation can be performed by, in the use of $NH_3$, changing it to $NH_4^+$ and by, in the use of a thioether compound, oxidizing a thioether group thereof.

By virtue of the ripening, the proportion of the number of tabular grains is preferably increased to at least 1.5-fold, more preferably, 3 to 500-fold and, most preferably, 6 to 200-fold. The increase of the proportion of tabular grains is followed by the growth step. The grain formation modes of tabular grains according to the present invention are classified as follows:

(1) seed formation according to either one of the modes (C)-1. 1) and 2), then optionally followed by measures for lowering adsorptive strength of the adsorbent, i.e., compound $A^0$ and/or compound $B^0$, then optionally followed by ripening, and then followed by growth, provided that at least one of the optional steps can be omitted, if appropriate; and (2) seed formation according to either one of the modes (C)-1. 3) and 4), then followed by ripening, and then followed by growth. The compound $A^0$ and/or compound $B^0$ with appropriate adsorptive strength can be added within a period from before ripening to 5 min before the termination of the growth, preferably, after ripening but before the growth.

The measures for lowering the adsorptive strength of the compound $A^0$ and/or compound $B^0$ will be described below. (i) In the case where the adsorbent is the compound $A^0$, the pH is lowered to (adsorbent's pKa+0.5) or less, preferably, (adsorbent's pKa+0.2) or less and, more preferably, between adsorbent pKa and (adsorbent's pKa−4.0). (ii) In the case where the adsorbent is the compound $B^0$, the above adsorptive strength can be lowered by selecting the pH and $X^-$ concentration of the reaction mixture. In many instances, the lower the pH value of the reaction mixture, or the greater the $X^-$ concentration, the lower the adsorptive strength. The lowering of the pH value would convert the alcoholic hydroxy group to $—OH_2^+$ and react the alcoholic hydroxy group with a hydrogen halide to thereby induce the change:

$$R—OH+HX \rightarrow R—X+H_2O,$$

so that the above effect would be exerted. Further, the measures for lowering the adsorptive strength of the adsorbent include (iii) a method in which an oxidizer such as $H_2O_2$ or $KMnO_4$ is added to thereby oxidize the alcoholic hydroxy group into an aldehyde or a carboxylic acid, (iv) a method in which the alcoholic hydroxy group is esterified, (v) a method in which a dehydration reaction is carried out, and (vi) a method in which a reaction with a phosphorus trihalide is carried out. For details of these, reference can be made to Morrison Boyd Organic Chemistry, 6th edition, chapter 6, Tokyo Kagaku Dozin (1994); and The Chemistry of the hydroxyl group, edited by S. Patai, Interscience Publishers (1971), the disclosures of which are herein incorporated by reference.

Moreover, (vii) a method in which a dispersion medium capable of inhibiting the defect formation is added can be mentioned as the measure which is effective in both the compounds $A^0$ and $B^0$. For example, gelatin is added. In this instance, the ratio of the weight of gelatin to the weight of the adsorbent is increased to at least 0.1, preferably, 0.3 to 300 and, more preferably, 1 to 100. (viii) A method in which heating is conducted can be mentioned as the measure. When the temperature is raised, generally, the equilibrium of adsorption ⟷ desorption shifts toward the right side, i.e., desorption. The temperature is preferably raised by 5 to 60° C., more preferably, 10 to 50° C. (ix) A method in which part or all, preferably, 10 to 100%, more preferably, 20 to 90%, of the adsorbent, i.e., the compound $A^0$ and/or compound $B^0$, is removed outside the system can be mentioned as the measure. For example, the centrifugal separation method or the filtration method using an ultrafilter member can be employed. In this instance, the removal is preferably conducted after the addition of the compound (vii) mentioned above, e.g. gelatin. Suitable dispersion medium and gelatin can be selected from the conventional photographic dispersion mediums, and reference can be made to the literature cited below. These measures enable substantially avoiding the defect formation during the growth period. In the present invention, in the above mode (2) as well, it is preferred that substantially no defect formation be conducted during the growth period. The term "substantially" means that the amount of defects formed during the growth period is up to 30%, preferably, 0 to 10% and, more preferably, 0 to 2% of the amount of defects existing just before the growth. In this instance, the capability of configuration control during the grain growth period is preferably sustained. When the adsorptive strength of the adsorbent, i.e., the compound $A^0$ and/or compound $B^0$, is reduced, first, the capability of defect formation is extinguished. When the adsorptive strength is further reduced, the capability of configuration control is also decreased until it becomes identical with that of common gelatin. Therefore, the above mode can be realized by appropriately reducing the adsorptive strength. The term "capability of configuration control" means the power of making the equilibrium crystal habit potential defined in the above relationship of silver potential versus AgBr grain configuration, shift toward the lower potential side by at least 10 mV, preferably, 20 to 150 mV, more preferably, 30 to 120 mV and, most preferably, 50 to 100 mV relative to the gelatin system.

In the mode (2) above, the added compound $A^0$ and/or compound $B^0$, acts as a configuration controlling agent, not as the defect forming agent. A more straightforward explanation of the capability of configuration control is as follows. A mode is indicated in which, when the tabular grains are grown under the same conditions except for the presence of the controlling agent and the following conditions, the thickness increase attained in the presence of the controlling agent during the growth is up to 80%, preferably, 0 to 60% and, more preferably, 0 to 30% of that attained in the absence of the controlling agent. The conditions exempted are the pH of the reaction mixture, i.e., optimum conditions (conditions for most effectively suppressing the thickness increase) can independently be selected within the range of 1 to 11. Further, the $X^-$ concentration can also be freely selected. In this case, the $X^-$ concentration leading to the formation of the tabular grains with the same thickness, exhibited in the presence of the controlling agent, are at least 1.5 times, preferably, 2 to 100 times that exhibited in the absence of the controlling agent.

The formation of the tabular grains in the presence of the adsorbent $C^0$ alone is described in EP 0534395A1. However, the effect of the compound $A^0$ having per molecule at least two residual groups of the covalently bonded adsorbent $C^0$ is much greater than that of the adsorbent $C^0$ per se. The reason would be that the adsorption energy of the compound $A^0$ having, per molecule, n residual groups of adsorbent $C^0$ bonded thereto is approximately $n \times EC^0$, provided that $EC^0$ represents the adsorption energy exhibited when the adsorbent $C^0$ is adsorbed onto {100} faces of AgX grains. That is, the reason would be that, even if $EC^0$ is small, the adsorptive strength can substantially freely be selected by selecting the value of n. Therefore, at the time of crystal defect formation, a mode of large adsorptive strength can be realized. On the other hand, at the time of growth, the adsorptive strength can be reduced, for example, by regulating the pH to the pKa value of compound $A^0$ or below. The adsorptive strength can be reduced to substantially nil by lowering the pH to (pKa−1.0) or below. Therefore, there is an advantage that the adsorptive strength can freely be regulated within a wider range, so that a superior effect can be exerted.

Figure 2:
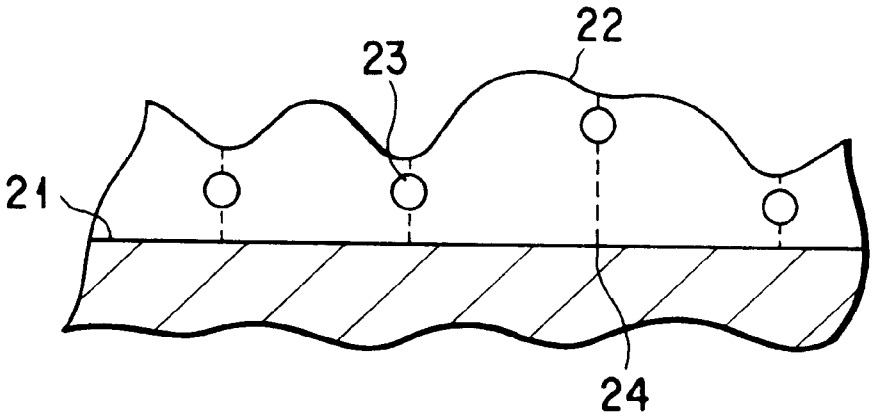
FIG. 2 is a schematic view showing a mode of adsorption of compound $A^0$.

As in the mode (2) above, when the compound $A^0$ is present at the time of growth, a mode such that there is no additional defect formation, growth inhibition is slight and grain configuration is controlled, can be realized by selecting the adsorbent $C^0$ with a small adsorptive strength in an initial stage and by selecting large n, i.e., the number of residual groups of covalently bonded compound $C^0$. The reason would be as follows. Referring to FIG. 2, although a multiplicity of adsorption sites 24 per molecule are provided so that the adsorption mode is maintained, holding the capability of grain configuration control, the adsorptive strength of each adsorption site is so small that adsorption and desorption are frequently repeated at each adsorption site. The lamination of $Ag^+$ and $X^-$ becomes feasible at the time of the desorption. In FIG. 2, numeral 21 denotes the surface of a AgX grain, numeral 22 denotes the principal chain of the compound $A^0$, and numeral 23 denotes the residual group of adsorbent $C^0$ covalently bonded to the principal chain of the compound $A^0$.

On the other hand, the compound $B^0$ is also strongly adsorbed on the AgX grains so that the crystal defects can be formed and, further, enables controlling the growth performance substantially without forming the defects at the time of growth. The defect forming action of the polyhydric alcoholic compound and the configuration controlling action thereof at the time of growth of the tabular grains have not been recognized in the art and are novel. The effect of the polyhydric alcoholic compound is superior to that of the compound $A^0$. In this instance, the greater the number of alcoholic hydroxy groups per molecule (thus, the greater the molecular weight), or the greater the value of x1, i.e., the ratio of number of alcoholic hydroxy group to number of all functional groups, the greater the adsorptive strength. Therefore, the adsorptive strength can also be regulated by regulating these values.

With respect to both the compounds $A^0$ and $B^0$, the greater the proportion of non-adsorptive water-soluble functional groups per molecule, the smaller the adsorptive strength. The non-adsorptive water-soluble functional groups help the adsorbent to freely swim around in a non-adsorbed state in the reaction mixture. The compounds $A^0$ and $B^0$ can be used in combination in a suitable proportion.

The mode of adsorption of the polyhydric alcoholic compound onto the surface of AgX grains is complicated. When added at a pH regulated to the pKa or above, the redisual group of the adsorbent $C^0$ is adsorbed on $Ag^+$ site of the surface of AgX grains to thereby lower the ion conductivity ($\sigma i$) of AgX grains. However, when the compound $B^0$ was adsorbed on AgX grains, it was found that all of the cubic AgBr grains, octahedral AgBr grains and cubic AgCl grains had their $\sigma i$ values increased. This adsorbent, i.e., adsorbent capable of promoting the formation of {100} faces and increasing the $\sigma i$ of grains, has not been known and is a novel phenomenon. In particular, the increase of the $\sigma i$ of cubic AgBr grains was twice or more. Therefore, this adsorbent would exhibit a strong interaction with the $X^-$ of the surface of grains to thereby exert an effective configuration controlling capability. The $\sigma i$ was measured by a dielectric loss method.

In the present invention, it is preferred that the defect formation be substantially completed before the initiation of grain growth. The amount of silver salt added before the initiation of grain growth is preferably up to ½, more preferably, up to ¼ of the total amount of silver salt added throughout the grain formation.

During the seed formation and growth, it is more suitable to use the adsorbent, i.e., compound $A^0$ and/or compound $B^0$, in combination with gelatin than to use the adsorbent alone. Conventional gelatins can be used in a concentration of, preferably, 0.05 to 10 g/L and, more preferably, 0.2 to 5 g/L. The ratio of the weight of the compound $A^0$ and/or compound $B^0$, to the weight of gelatin preferably ranges from 0.01 to 0.9, more preferably, 0.03 to 0.5 and, most preferably, 0.06 to 0.3.

Although the temperature during seed crystal formation can be 10 to 90° C., the temperature during each defect formations 1) and 2) above is preferably 30 to 90° C., more preferably, 40 to 85° C. The defect forming capability, exhibited to AgCl fine grains, of the compound $B^0$ is the maximum when the pH is approximately 4 at a temperature ranging from 50 to 85° C., and, the farther therefrom the pH value, the lower the defect forming capability.

(D) Other:

In the present invention, the term "seed formation period" means a period from the initiation of AgX nucleation to the start of temperature rise. The term "ripening period" means a period from the start of temperature rise to the start of growth. The term "growth period" means a period from the start of growth to the end of growth. The most suitable conditions in the seed formation period, ripening period and growth period can be selected from the combinations of a pH within the range of 1 to 11, preferably, 1.7 to 9 and an $X^-$ concentration within the range of up to $10^{-0.9}$ mol/L, preferably, $10^{-4}$ to $10^{-1.2}$ mol/L.

(E) Process for Producing AgX Emulsion:

The AgX emulsion containing the above AgX grains is preferably produced by the process comprising seed crystal formation→ripening→growth→desalting→re-dispersion and is finally applied onto a support.

The formed AgX emulsion is preferably desalted before the application to the support to thereby remove soluble unneeded matter. This desalting can be performed by any of (1) the Nudel water washing method; (2) the sedimentation water washing method in which a sedimentation water washing is conducted by adding a coagulating sedimentation agent; (3) the sedimentation water washing method in which a sedimentation water washing is conducted with the use of coagulating sedimentation characteristics of a modified gelatin such as phthalated gelatin; (4) the method employing centrifugation, hydrocyclone, centrifugal filtration or ultrafiltration; (5) the use of electrodialysis; (6) the use of an ion exchange resin; and the use of at least two thereof in combination. For details of these, reference can be made to the description of, for example, R. D. vol. 501, item 36544 (1994, September), the disclosure of which is herein incorporated by reference. The Agx emulsion can also be applied onto a support without passing through the desalting.

In the present invention, at least one of the below described chemical sensitizer is often added to the formed AgX emulsion before the coating thereof so that the AgX emulsion is chemically sensitized. Further, in accordance with the object, at least one spectral sensitizing dye is added to the AgX emulsion so that the AgX emulsion is spectrally sensitized. The chemical sensitization and the spectral sensitization can be performed prior to the desalting or thereafter. Still further, in accordance with the object, either can the chemical sensitization be carried out prior to the spectral sensitization or the spectral sensitization can be carried out prior to the chemical sensitization. However, the process preferably comprises (i) preparation of the AgX emulsion→(ii) adding a spectral sensitizing dye to thereby exchange the adsorped adsorbent with the sensitizing dye→(iii) removing the adsorbent desorbed by the emulsion water washing method from the emulsion and redispersing it. The chemical sensitization can be performed either after any of the steps (i), (ii) and (iii) or during the step (ii). The step (ii) can be omitted when a spectral sensitization of the AgX emulsion is not necessary and when the adsorbent is not detrimental to the photographic performance.

With respect to AgBrICl tabular grains (AgI content: 1 to 20 mol %, preferably, 1 to 10 mol %) whose AgCl content is 30 mol % or less, preferably, from 0 to 10 mol % and, more preferably, 0 mol %, especially, tabular grains prepared at a pH of 5.0 to 10.5, preferably, 6.0 to 10.0, a potential by silver rod of 0 to 120 mV, preferably, 20 to 100 mV and a temperature of 40 to 95° C., preferably, 50 to 85° C. are excellent in sensitivity and image quality.

An oxidizer and/or a reducing agent may be added to the monodispersed silver halide emulsion of the invention, in order to regulate the state of oxidation and/or reduction of AgX grains. The oxidizer and/or the reducing agent may be added at any time from the initiation of grain formation to immediately before coating. The oxidizer and/or the reducing agent may preferably be added at any time from the initiation of grain formation to the completion of the grain formation. When the amount of reduced silver nuclei produced during the grain formation is so large that the fog density is too high in finally obtained photographic images, it is preferred to add the oxidizer.

The above-mentioned oxidizers can be used as this oxidizer. Especially, organic compounds containing at least one thiosulfonic acid group, organic compounds containing at least one sulfinic acid group, organic compounds containing at least one thiosulfonic acid group and at least one sulfinic acid group, water soluble disulfide compounds, diaminodisulfide compounds and dichalcogen compounds are preferred. For details of these compounds, reference can be made to EP 0435355A1, EP 0358170, PCT National Publication 5-505258, JP-A-6-19024, JP-A-6-35147, JP-A-7-199398, JP-A-7-199396 and U.S. Pat. No. 5,418,127, the disclosures of which are herein incorporated by reference.

The above-mentioned reducing agents can be used as this reducing agent. Especially, borane compounds, hydrazine derivatives, silane compounds, polyamines, sulfites, amines, formamidinesulfinic acid, ascorbic acid derivatives, hydroquinone derivatives, thiourea dioxides, stannous chloride, alkynylamines, reducing sugars and aminoboranes are preferred. For details of these compounds, reference can be made to U.S. Pat. No. 3,361,564, U.S. Pat. No. 2,419,974, U.S. Pat. No. 2,694,637, U.S. Pat. No. 2,518,698, U.S. Pat. No. 2,983,609, U.S. Pat. No. 2,487,850, U.S. Pat. No. 5,457,019, U.S. Pat. No. 5,030,552, JP-A-7-92591 and JP-A-7-199398, the disclosures of which are herein incorporated by reference.

The method of adding at least one of $Br_2$ and $I_2$, and a reducing agent (reference can be made to the description of item (C)-1. 3) above) can be preferably employed for feeding $X^-$ during the grain formation or in order to modify the surface of grains after the grain formation.

The AgX grains for use in the present invention can be chemically sensitized. Preferred chemical sensitization can be attained by at least one of the chalcogen sensitization and noble metal sensitization. The use of at least two sensitization methods in combination is more preferred. The chalcogen sensitization includes sulfur, selenium and tellurium sensitizers. The noble metal sensitization includes gold, platinum, palladium and iridium sensitizations. Of the noble metal sensitization, the gold sensitization, the palladium sensitization and a combination thereof are preferred. Of the combinations of chalcogen sensitization and noble metal sensitization, a combination of sulfur sensitization and gold sensitization is preferred. These sensitizers are preferably used in an amount of $1\times10^{-4}$ to $1\times10^{-7}$ mol, more preferably, $1\times10^{-5}$ to $5\times10^{-7}$ per mol of silver halide contained in the emulsion.

The above chemical sensitizations can be performed by the use of active gelatin as described in T. H. James, The Theory of the Photographic Process, 4th ed., Macmillan, 1977, p.p. 67–76, the disclosure of which is herein incorporated by reference. Also, the chemical sensitization can be performed by the use of a sulfur sensitizer, a selenium sensitizer, a tellurium sensitizer, a gold sensitizer, a platinum sensitizer, a palladium sensitizer, an iridium sensitizer or a combination thereof at a pAg of 5 to 10, a pH of 5 to 8 and a temperature of 30 to 80° C. as described in Research Disclosure, vol. 120, April 1974, 12008, Research Disclosure, vol. 34, June 1975, 13452, U.S. Pat. No. 2,642,361, U.S. Pat. No. 3,297,446, U.S. Pat. No. 3,772,031, U.S. Pat. No. 3,857,711, U.S. Pat. No. 3,901,714, U.S. Pat. No. 4,266,018, U.S. Pat. No. 3,904,415 and G.B. 1,315,755, the disclosure of which are herein incorporated by reference.

The above chemical sensitizations can be performed at any of the stages of the silver halide emulsion producing process. Various types of emulsions can be prepared depending on at which of the stages the chemical sensitization is carried out. These include, for example, the type in which a chemical sensitization nucleus is implanted in an inner portion of the grains, the type in which the implantation is performed in a site shallow from the grain surface and the type in which the chemical sensitization nucleus is set in the grain surface. Although the emulsion type can appropriately be selected depending on the object, it is generally preferred that at least one chemical sensitization nucleus be provided in the vicinity of the grain surface.

Representative compounds used for the chemical sensitizations will be described below.

In order to perform sulfur sensitization, hypo, thiourea compounds, rhodanine compounds and sulfur-containing compounds described in U.S. Pat. Nos. 3,857,711, 4,266,018 and 4,054,457, can be used. Although the amount of the sulfur sensitizer to be used varies depending on the conditions during the chemical sensitization, such as pH, temperature and grain size, $1\times10^{-7}$ to $5\times10^{-5}$ mol per mol of AgX is preferred. After the addition of the chemical sensitizer, the emulsion is stirred for a certain period of time at a high temperature, preferably at 40° C. or more. Chemical sensitization can be effected in the presence of a chemical sensitization auxiliary commonly so termed. Suitable chemical sensitization auxiliaries are compounds capable of inhibiting fog in the course of chemical sensitization and capable of increasing sensitivity, such as azaindene, azapyridazine and azapyrimidine. Examples of chemical sensitization auxiliary modifiers are set forth in U.S. Pat. Nos. 2,131,038, 3,411,914 and 3,554,757, JP-A-58-126526 and the above Duffin, "Chemistry of Photographic Emulsion", p.p. 138–143, the disclosures of which are herein incorporated by reference.

In the selenium sensitization, use can be made of known unstable selenium compounds or non-unstable selenium compounds. Unstable selenium compounds are more preferable. Specifically, colloidal metal selenium, selenoureas (e.g., N,N-dimethylselenourea and N,N-diethylselenourea), selenoketones, selenoamides and other selenium compounds, can be used. Although the amount of the selenium sensitizer to be used varies depending on the conditions during the chemical sensitization, such as activity of the used selenium sensitizer, composition of AgX, grain size, ripening temperature, and period of the sensitization, the amount is preferably $10^{-8}$ mol or more pre mol of AgX, and more preferably $10^{-7}$ to $5\times10^{-5}$ mol per mol of AgX. The ripening temperature in the case where the selenium sensitizer is used is preferably 45° C. or more, and more preferably 50 to 80° C. The pAg during the chemical sensitization can be set arbitrary, however, pAg of 7.5 or more is preferable, and 8.0 or more is more preferable. The pH during the chemical sensitization is preferably 7.5 or less, and more preferably 6.8 or less. The above preferable conditions may be applied to alone, however, any combination of at least two preferable conditions may preferably be applied to. In the present invention, in the case where selenium sensitization is performed, it is most preferred to employ the selenium sensitization in combination with the sulfur sensitization and gold sensitization.

In the case where gold sensitization is performed, at least one of the known compounds such as chloroauric acid, potassium chloroaurate, potassium auriothiocyanate, gold sulfide and gold selenide, can be used. Theses gold compounds are preferably used in combination with a thiocyanate salt or a selenocyanate salt. The amount of the gold sensitizer to be used varies depending on the conditions during the chemical sensitization, the amount of $1\times10^{-7}$ to $5\times10^{-5}$ mol per mol of AgX is preferred.

In the case where a palladium sensitization is performed, at least one of the divalent and tetravalent palladium salts can be used. Preferable palladium compounds are represented by a general formula $R_2PdX_6$ or a general formula $R_2PdX_4$, wherein R represents a hydrogen atom, an alkali metal atom or an ammonium group, x represents chlorine, bromine or iodine atom. Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2Pd\ Br_4$ are preferably used. These palladium compounds are preferably used in combination with a thiocyanate salt or a selenocyanate salt. The amount of the palladium sensitizer to be used varies depending on the conditions during the chemical sensitization, the amount of $1\times10^{-7}$ to $5\times10^{-5}$ mol per mol of AgX is preferred.

It is preferred that the AgX grains for use in the present invention be spectrally sensitized by the addition of a spectral sensitizing dye such as a methine dye or the like from the viewpoint that the effects desired in the present invention can be fully exerted. Although the amount of the spectral sensitizing dye added during the preparation of silver halide emulsion depends on the type of additives and the amount of silver halide and cannot unitarily be specified, preferred use can be made of the amount added in the conventional process, i.e., 50 to 90% of the saturated coating amount. Illustratively, the addition amount of the spectral sensitizing dye preferably ranges from 0.001 to 100 mmol, more preferably, from 0.01 to 10 mmol per mol of silver halide.

Examples of dyes which can be used in the spectral sensitization include cyanine dyes, merocyanine dyes, composite cyanine dyes, composite merocyanine dyes, holopolar cyanine dyes, hemicyanine dyes, styryl dyes and hemioxonol dyes. Particularly useful spectral sensitizing dyes are cyanine dyes, merocyanine dyes and composite merocyanine dyes. Of these, cyanine dyes are most preferred. A basic heterocyclic nucleus generally possessed by cyanine dyes may be present in each molecule of the above spectral sensitizing dyes as part of their structures. That is, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, a pyridine nucleus or the like may be present in the molecule of the spectral sensitizing dye. Further, a nucleus comprising the above nucleus fused with an alicyclic hydrocarbon ring or a nucleus comprising the above nucleus fused with an aromatic hydrocarbon ring may be present in the molecule of the spectral sensitizing dye. The latter nucleus is, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus. At least one substituent may be present on carbon atoms of the above basic heterocyclic rings. Still further, any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus may be present as a nucleus having a ketomethylene structure in the merocyanine dye or composite merocyanine dye.

These spectral sensitizing dyes may be used either individually or in combination. Especially when a supersensitization is intended, it is often to use a plurality of spectral sensitizing dyes in combination. Representative examples thereof are described in the specifications of U.S. Pat. No. 2,688,545, U.S. Pat. No. 2,977,229, U.S. Pat. No. 3,397,060, U.S. Pat. No. 3,522,052, U.S. Pat. No. 3,527,641, U.S. Pat. No. 3,617,293, U.S. Pat. No. 3,628,964, U.S. Pat. No. 3,666,480, U.S. Pat. No. 3,672,898, U.S. Pat. No. 3,679,428, U.S. Pat. No. 3,703,377, U.S. Pat. No. 3,769,301, U.S. Pat. No. 3,814,609, U.S. Pat. No. 3,837,862, U.S. Pat. No. 4,026,707, GB 1,344,281, GB 1,507,803, Jpn. Pat. Appln. KOKOKU Publication No. (hereinafter referred to as JP-B-) 43-4936, JP-B-53-12375, JP-A-52-110618 and JP-A-52-109925, the disclosures of which are incorporated by reference. The emulsion of the present invention may further be doped with a dye which exerts no spectral sensitizing effect or a substance which absorbs substantially none of visible radiation and exhibits supersensitization.

The spectral sensitizing dye may be added to the emulsion at any stage of the process for preparing the emulsion which is known as being useful. Although the addition is generally conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the spectral sensitizing dye can be added in a plurality of divisions, as taught in U.S. Pat. No. 4,225,666. Thus, for example, part of the spectral sensitizing dye can be added prior to the chemical sensitization with the rest of the spectral sensitizing dye added after the chemical sensitization. Still further, the spectral sensitizing dye may be added at any stage during the formation of silver halide grains, as disclosed in U.S. Pat. No. 4,183,756. The spectral sensitizing dye is preferably added to the emulsion during the chemical sensitization is added and, more preferably, prior to the chemical sensitization. The disclosures of all the disclosures in this paragraph are herein incorporated by reference.

In the lightsensitive material of the present invention, it is only required that at least one silver halide emulsion layer selected from among a blue-sensitive layer, a green-sensitive layer and a red-sensitive layer be formed on a support. There is no particular limitation on the number of silver halide emulsion layers, the number of non lightsensitive layers and the layer sequence. A typical example is a silver halide photographic lightsensitive material having, on its support, at least one lightsensitive layer constituted by a plurality of silver halide emulsion layers which are sensitive to essentially the same color but have different sensitivities. This lightsensitive layer includes a unit lightsensitive layer which is sensitive to one of blue light, green light and red light. In a multi-layered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

Various non lightsensitive layers such as an intermediate layer can be formed between the silver halide lightsensitive layers and as the uppermost layer and the lowermost layer.

These intermediate layers may contain, e.g., couplers and DIR compounds as described in JP-A-61-43748, 59-113438, 59-113440, 61-20037 and 61-20038 and also may contain commonly employed color mixing inhibitors.

As for a plurality of silver halide emulsion layers constituting respective unit lightsensitive layer, a two-layered structure of high- and low-speed emulsion layers can be preferably used as described in DE (German Patent) 1,121,470 or GB 923,045. Generally, it is preferred that a layer arrangement be made so that the sensitivity is sequentially decreased toward a support, and a non lightsensitive layer may be disposed between silver halide emulsion layers. Also, as described in JP-A-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted. Furthermore, the order of the arrangement can also be altered as described above in the case where four or more layers each may have different sensitivities are coated.

In order to enhance the color reproducibility, at least one donor layer (CL) having an interlayer effect in which a spectral sensitivity distribution is different from that of the main lightsensitive layers such as BL, GL and RL, as described in U.S. Pat. No. 4,663,271, U.S. Pat. No. 4,705,744, U.S. Pat. No. 4,707,436, JP-A-62-160448 and JP-A-63-89850, are preferably disposed adjacent to or close to one of the main lightsensitive layers.

As apparent from the above, various layer structures and arrangements can be selected in conformity with the object of each lightsensitive material.

In the process of producing the photographic lightsensitive material according to the present invention, generally, photographically useful substances are added to a photographic coating liquid. That is, they are added to a hydrophilic colloid liquid.

The photographic lightsensitive material of the present invention, after imagewise exposure, is generally processed by an alkali developer containing a developing agent. After the color development, the color photographic lightsensitive material is subjected to an image forming procedure in which the lightsensitive material is processed with a processing solution having bleaching capability which contains a bleaching agent.

Although the AgX emulsion of the present invention can be used in any of the conventional photographic lightsensitive materials, preferred use thereof is made in a silver halide color photographic lightsensitive material, especially, a silver halide color reversal photographic lightsensitive material.

With respect to various techniques and organic and inorganic materials which can be employed in the silver halide photographic emulsion of the present invention and the silver halide photographic lightsensitive material using the same, use can generally be made of those described in Research Disclosure No. 308119 (1989) and No. 37038 (1995).

In addition, more specifically, for example, techniques and organic and inorganic materials which can be used in the silver halide photographic emulsion and the silver halide color photographic material of the present invention are described in the following portions of EP 436,938A2 and the patents cited below, all the disclosures of which are herein incorporated by reference.

Item: Relevant Part

1. Yellow coupler: page 137, line 35 to page 146, line 33 and page 149, lines 21 to 23
2. Magenta coupler: page 149, lines 24 to 28; EP 421,453A1, page 3, line 5 to page 25, line 55
3. Cyan coupler: page 149, lines 29 to 33; EP 432,804A2, page 3, line 28 to page 40, line 2
4. Polymer coupler: page 149, lines 34 to 38; EP 435,334A2, page 113, line 39 to page 123, line 37
5. Colored coupler: page 53, line 42 to page 137, line 34 and page 149, lines 39 to 45
6. Other functional couplers: page 7, line 1 to page 53, line 41 and page 149, line 46 to page 150, line 3; EP 435, 334A2, page 3, line 1 to page 29, line 50
7. Antiseptic and mildewproofing agents: page 150, lines 25 to 28
8. Formalin scavenger: page 149, lines 15 to 17
9. Other additives: page 153, lines 38 to 47; EP 421,453A1, page 75, line 21 to page 84, line 56 and page 27, line 40 to page 37, line 40
10. Dispersion method: page 150, lines 4 to 24
11. Support: page 150, lines 32 to 34
12. Thickness/properties of film: page 150, lines 35 to 49
13. Color development step, black and white development and fogging step: page 150, line 50 to page 151, line 47; EP 442,323A2, page 34, line 11 to line 54, page 35, line 14 to line 22.
14. Desilvering step: page 151, line 48 to page 152, line 53
15. Automatic processor: page 152, line 54 to page 153, line 2
16. Washing with water/stabilization step: page 153, lines 3 to 37.

EXAMPLES

The present invention will be described in more detail below by way of its examples. However, the present invention is not limited to these examples.

(1) Preparation of Emulsion:

a) Preparation of Emulsion Em-1:

60 mL of a 0.5M silver nitrate solution and 60 mL of a 0.5M potassium bromide solution were added by a double jet method to 1.4 L of a 1.0% by weight gelatin solution containing 9.52 g of potassium bromide under agitation over a period of 30 sec. During the addition, the temperature was maintained at 30° C. After the addition, the temperature was raised to 75° C. Thereafter, 105 mL of a 1.0M silver nitrate solution was slowly added, followed by addition of $NH_4OH$, thereby adjusting the pH value and maintained it at 9.5 for 20 min, and then returned the pH value to the original. Further, a silver nitrate solution containing 150 g of silver nitrate was added at an accelerated flow rate (the final flow rate was 19 times the initial flow rate) over a period of 120 min. During this period, a KBr solution was added so that the pBr value was maintained at 2.05. During the above double jet addition, the addition was intermitted when 80% of the total silver amount was added. 6.1 g of KI in the form of a 1.5% aqueous solution was added at a fixed rate over a period of 7 min, and thereafter the double jet addition was resumed. Thus, the grain formation was completed.

The resultant emulsion was cooled to 35° C. and washed with water according to the customary flocculation method. A gelatin solution was added to thereby redisperse the emulsion, and the pH and pAg values at 40° C. were adjusted to 6.5 and 8.6, respectively.

An aliquot of the emulsion was sampled, and the TEM image (transmission electron micrograph image) of a replica of emulsion grains was observed. Thus, it was found that 95% of the total projected area of all AgX grains were occupied by tabular grains having principal planes composed of {111} faces, and the average aspect ratio was 4.0. The average equivalent sphere diameter and variation coefficient of the equivalent sphere diameter distribution of the AgX grains were 0.40 μm and 21%, respectively.

b) Preparation of Emulsion Em-2:

Emulsion Em-2 was prepared in the same manner as emulsion Em-1 except that the silver amount, temperature and potential were appropriately regulated.

An aliquot of the emulsion was sampled, and the TEM image of a replica of emulsion grains was observed. Thus, it was found that 94% of the total projected area of all AgX grains were occupied by tabular grains having principal planes composed of {111} faces, and the average aspect ratio was 3.8. The average equivalent sphere diameter and variation coefficient of the equivalent sphere diameter distribution of the AgX grains were 0.20 μm and 24%, respectively.

c) Preparation of Emulsion Em-3:

Emulsion Em-3 was prepared in the same manner as emulsion Em-1 except that the silver amount, temperature and potential were appropriately regulated.

An aliquot of the emulsion was sampled, and the TEM image of a replica of emulsion grains was observed. Thus, it was found that 94% of the total projected area of all AgX grains were occupied by tabular grains having principal planes composed of {111} faces, and the average aspect ratio was 3.9. The average equivalent sphere diameter and variation coefficient of the equivalent sphere diameter distribution of the AgX grains were 0.25 μm and 23%, respectively.

d) Preparation of Emulsion Em-4:

Emulsion Em-4 was prepared in the same manner as emulsion Em-1 except that the silver amount, temperature and potential were appropriately regulated.

An aliquot of the emulsion was sampled, and the TEM image of a replica of emulsion grains was observed. Thus, it was found that 95% of the total projected area of all AgX grains were occupied by tabular grains having principal planes composed of {111} faces, and the average aspect ratio was 3.9. The average equivalent sphere diameter and variation coefficient of the equivalent sphere diameter distribution of the AgX grains were 0.32 μm and 23%, respectively.

e) Preparation of Emulsion Em-5:

A 0.5M silver nitrate solution and the same 0.5M potassium bromide solution as above were added each in an amount of 41 mL by a double jet method to 0.75 L of a 0.8% low molecular weight (molecular weight: 10,000) gelatin solution containing 0.025 mol of potassium bromide under agitation over a period of 30 sec. During the addition, the gelatin solution was maintained at 40° C. Thus, a nucleation was performed. During the nucleation, the pH of the gelatin solution was 5.0.

After the nucleation, a potential regulation to a pBr of 2.05 was conducted with the use of KBr. Thereafter, the temperature was raised to 75° C., 220 mL of a 10% deionized alkali-treated bone gelatin solution was added, and the emulsion was ripened for 10 min.

Subsequently, 150 g of silver nitrate and a solution of potassium iodide and potassium bromide were added over a period of 60 min while maintaining the potential at 0 mV according to a controlled double jet method at an accelerated flow rate such that the final flow rate was 19 times the initial flow rate, thereby growing grains. After the completion of the growth addition, the temperature was lowered to 50° C., the pBr was adjusted to 1.5 with the use of potassium bromide, and 354 mL of a 2% potassium iodide solution was added. Thereafter, 327 mL of a 0.5M silver nitrate solution and a 0.5M potassium bromide solution were added at a potential of 0 mV over a period of 20 min according to a controlled double jet method to thereby form a shell. Then, the resultant emulsion was washed with water at 35° C. according to a known flocculation method, and gelatin was added and heated to 60° C. to thereby effect a re-dispersion.

An aliquot of the emulsion was sampled, and the TEM image of a replica of emulsion grains was observed. Thus, it was found that 95% of the total projected area of all AgX grains were occupied by tabular grains having principal planes composed of {111} faces, and the average aspect ratio was 4.1. The average equivalent sphere diameter and variation coefficient of the equivalent sphere diameter distribution of the AgX grains were 0.63 μm and 20%, respectively.

f) Preparation of Emulsion Em-6:

Emulsion Em-6 was prepared in the same manner as emulsion Em-5 except that the silver amount, temperature and potential were appropriately regulated.

An aliquot of the emulsion was sampled, and the TEM image of a replica of emulsion grains was observed. Thus, it was found that 96% of the total projected area of all AgX grains were occupied by tabular grains having principal planes composed of {111} faces, and the average aspect ratio was 4.0. The average equivalent sphere diameter and variation coefficient of the equivalent sphere diameter distribution of the AgX grains were 0.50 μm and 21%, respectively.

g) Preparation of Emulsion Em-7:

Emulsion Em-7 was prepared in the same manner as emulsion Em-5 except that the silver amount, temperature and potential were appropriately regulated.

An aliquot of the emulsion was sampled, and the TEM image of a replica of emulsion grains was observed. Thus, it was found that 95% of the total projected area of all AgX grains were occupied by tabular grains having principal planes composed of {111} faces, and the average aspect ratio was 4.2. The average equivalent sphere diameter and variation coefficient of the equivalent sphere diameter distribution of AgX grains were 0.79 μm and 20%, respectively.

h) Preparation of Emulsion Em-8:

Emulsion Em-8 was prepared in the same manner as emulsion Em-5 except that the silver amount, temperature and potential were appropriately regulated.

An aliquot of the emulsion was sampled, and the TEM image of a replica of emulsion grains was observed. Thus, it was found that 95% of the total projected area of all AgX grains were occupied by tabular grains having principal planes composed of {111} faces, and the average aspect ratio was 4.1. The average equivalent sphere diameter and variation coefficient of the equivalent sphere diameter distribution of the AgX grains were 1.00 μm and 19%, respectively.

i) Preparation of Emulsion Em-9:

A gelatin solution (1200 mL of water containing 24 g of deionized alkali-treated bone gelatin and 5 mL of 1 N potassium nitrate and adjusted to a pH of 4.0 with the use of 1N nitric acid) and $1\times10^{-3}$ mol of $C_2H_5SO_2S—CH_3$ were placed in a reaction vessel, and the temperature thereof was maintained at 35° C. 10 mL of an aqueous solution of silver nitrate (3 g/100 mL $AgNO_3$) was added while agitating, and, 5 min later, an aqueous solution of silver nitrate (20 g/100 mL $AgNO_3$) and an aqueous solution of silver iodobromide of equimolar concentration (KBr:KI=98:2 in molar ratio) were added at a rate of 48 mL/min over a period of 1 min. This addition was conducted by a simultaneous mixing method using a precision liquid feeding pump. Agitation was conducted for 1 min, and the pH value was adjusted to 6.1 with the use of an aqueous solution of potassium hydroxide and nitric acid. Further, the silver potential was adjusted to 160 mV with the use of an aqueous solution of silver nitrate (3 g/100 mL $AgNO_3$) and an aqueous solution of potassium bromide (3 g/100 mL KBr). Subsequently, the temperature was raised to 60° C. over a period of 10 min, and a ripening was performed for 30 min. 5 mL of an aqueous solution of ammonium nitrate (50% by weight) and 5 mL of aqueous ammonia (25% by weight) were added, and an aqueous solution of silver nitrate (10 g/100 mL $AgNO_3$) and an aqueous solution of silver iodobromide (containing 6.7 g of KBr and 0.42 g of KI in 100 mL) were added while maintaining a silver potential at 120 mV by a controlled double jet method. The flow rate was 10 mL/min, and a total of 420 mL was added according to a constant flow rate addition method. Agitation was conducted for 2 min, the temperature was lowered to 30° C. and water washing was conducted according to the sedimentation water washing method. An aqueous solution of gelatin was added to thereby redisperse the emulsion, and the pH and pBr values were adjusted to 6.4 and 2.8, respectively.

As a result of observation of the TEM image of a replica of emulsion grains, it was found that 51% of the total projected area of all of AgX grains prepared by the above process were occupied by tabular grains having principal planes composed of {100} faces, and the average aspect ratio was 3.8. The average equivalent sphere diameter, variation coefficient of the equivalent sphere diameter distribution and the average I content of all the silver halide grains of the emulsion were 0.40 μm, 33% and 4 mol %, respectively.

j) Preparation of Emulsion Em-10:

Emulsion Em-10 was prepared in the same manner as emulsion Em-9 except that the addition at the final growth was conducted in accordance with a 0.05 mL/min linearly accelerated addition method in which the initial rate was 10 mL/min.

As a result of observation of the TEM image of a replica of emulsion grains, it was found that 54% of the total projected area of all of AgX grains prepared by the above process were occupied by tabular grains having principal planes composed of {100} faces (ratio of {100} faces of each grain based on the total surface area of each grain ≧80%), and the average aspect ratio was 4.1. The average equivalent sphere diameter, variation coefficient of the equivalent sphere diameter distribution and average I content of all silver halide grains of the emulsion were 0.40 μm, 24% and 4 mol %, respectively.

k) Preparation of Emulsion Em-11:

Emulsion Em-11 was prepared in the same manner as emulsion Em-9 except that the temperature after the potential adjustment was 55° C. and the ripening period was 40 min.

An aliquot of the emulsion was sampled, and the TEM image of a replica of emulsion grains was observed. Thus, it was found that 65% of the total projected area of all AgX grains were occupied by tabular grains having principal planes composed of {100} faces, and the average aspect ratio was 4.2. The average equivalent sphere diameter, variation coefficient of the equivalent sphere diameter distribution and average I content of all silver halide grains of the emulsion were 0.40 μm, 30% and 4 mol %, respectively.

l) Preparation of Emulsion Em-12:

An aqueous solution of gelatin No. 1 (1200 mL of water containing 25 g of gelatin and 0.36 g of KBr and exhibiting a pH of 4.2) was placed in a reaction vessel. While maintaining the temperature at 45° C. and stirring, a simultaneous mixing and addition of solution Ag-1 (1.17 mol/L $AgNO_3$) and solution X-1 (1.17 mol/L KBr) was carried out at a rate of 48 mL/min for 1 min. Two minutes later, 1N NaOH solution and an aqueous solution of polyvinyl alcohol (consisting of 0.1 L of water and 6.5 g of polyvinyl alcohol (hereinafter referred to as "PV-1") obtained from polyvinyl acetate having an average polymerization degree of 500 at an average degree of saponification to alcoholic hydroxy group of 98%) were added, and the pH of the reaction mixture was adjusted to 5.0. The reaction mixture was allowed to stand still for 8 min and heated to 66° C., and the pH thereof was adjusted to 6. Using the solution Ag-1 and solution X-2 (containing 1.123 mol/L of KBr and 0.0468 mol/L of KI), a constant flow rate double jet addition at the flow rate of the solution Ag-1 of 3.5 mL/min, was performed while maintaining the pBr at 3.1.

A precipitant was added, the temperature was lowered to 30° C. and the pH was adjusted to 4.0 to thereby precipitate the emulsion. The precipitated emulsion was washed with water, and a gelatin solution was added at 38° C. to thereby redisperse the emulsion. The pH and pAg of the dispersion were adjusted to 6.2 and 8.8, respectively.

As a result of observation of the TEM image of a replica of emulsion grains, it was found that 71% of the total projected area of all of AgX grains prepared by the above process were occupied by tabular grains having principal planes composed of {100} faces, and the average aspect ratio was 4.1. The average equivalent sphere diameter, variation coefficient of the equivalent sphere diameter distribution and average I content of all silver halide grains of the emulsion were 0.40 μm, 29% and 4 mol %, respectively.

m) Preparation of Emulsion Em-13:

{100} tabular emulsion Em-13 of the present invention was prepared in the same manner as emulsion Em-12, except that the temperature at the second-stage addition was 69° C., the amount of PV-1 was 6 g, and the addition at the final growth was performed according to a 0.05 mL/min linearly accelerated addition method in which the initial flow rate was 3.5 mL/min.

As a result of observation of the TEM image of a replica of emulsion grains, it was found that 82% of the total projected area of all of AgX grains prepared by the above process were occupied by tabular grains having principal planes composed of {100} faces, and the average aspect ratio was 4.2. The average equivalent sphere diameter, variation coefficient of the equivalent sphere diameter distribution and average I content of all silver halide grains of the emulsion were 0.40 μm, 22% and 4 mol %, respectively.

n) Preparation of Emulsion Em-14:

{100} tabular emulsion Em-14 of the present invention was prepared in the same manner as emulsion Em-12, except that the temperature at the second-stage addition was 72° C. and the amount of PV-1 was 5.5 g.

As a result of observation of the TEM image of a replica of emulsion grains, it was found that 86% of the total projected area of all of AgX grains prepared by the above process were occupied by tabular grains having principal planes composed of {100} faces, and the average aspect ratio was 4.0. The average equivalent sphere diameter, variation coefficient of the equivalent sphere diameter distribution and average I content of all silver halide grains of the emulsion were 0.40 μm, 20% and 4 mol %, respectively.

o) Preparation of Emulsion Em-15:

{100} tabular emulsion Em-15 of the present invention was prepared in the same manner as emulsion Em-12, except that the temperature at the second-stage addition was 75° C. and the amount of PV-1 was 5 g.

As a result of observation of the TEM image of a replica of emulsion grains, it was found that 96% of the total projected area of all of AgX grains prepared by the above process were occupied by tabular grains having principal planes composed of {100} faces, and the average aspect ratio was 4.2. The average equivalent sphere diameter, variation coefficient of the equivalent sphere diameter distribution and average I content of all silver halide grains of the emulsion were 0.40 μm, 19% and 4 mol %, respectively.

p) Preparation of Emulsion Em-16:

{100} tabular emulsion Em-16 of the present invention was prepared in the same manner as emulsion Em-15, except that an aqueous solution containing 10 g of copolymer 1 represented by the following formula (6) (x:y:z:w=60:8:10:25) was used in place of the PV-1.

copolymer 1

(6)

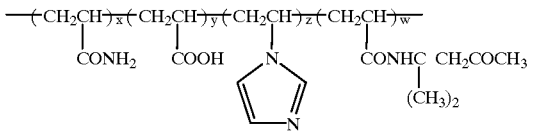

X:Y:Z:W=60:8:10:25 molecular weight: 150,000

As a result of observation of the TEM image of a replica of emulsion grains, it was found that 95% of the total projected area of all of AgX grains prepared by the above process were occupied by tabular grains having principal planes composed of {100} faces, and the average aspect ratio was 4.1. The average equivalent sphere diameter, variation coefficient of the equivalent sphere diameter distribution and average I content of all silver halide grains of the emulsion were 0.40 μm, 18% and 4 mol %, respectively.

q) Preparation of Emulsion Em-17:

{100} tabular emulsion Em-17 as a comparative example was prepared in the same manner as emulsion Em-15, except that the amount of KI in the halogen solution was changed to nil so that the iodine content became 0 mol %.

As a result of observation of the TEM image of a replica of emulsion grains, it was found that 96% of the total projected area of all of AgX grains prepared by the above process were occupied by tabular grains having principal planes composed of {100} faces, and the average aspect ratio was 4.5. The average equivalent sphere diameter and variation coefficient of the equivalent sphere diameter distribution of all silver halide grains of the emulsion were 0.40 μm and 17%, respectively.

r) Preparation of Emulsion Em-18:

{100} tabular emulsion Em-18 of the present invention was prepared in the same manner as emulsion Em-15, except that the amounts of KBr and KI in the halogen solution were changed so that the iodine content became 10.0 mol %.

As a result of observation of the TEM image of a replica of emulsion grains, it was found that 82% of the total projected area of all of AgX grains prepared by the above process were occupied by tabular grains having principal planes composed of {100} faces, and the average aspect ratio was 3.3. The average equivalent sphere diameter and variation coefficient of the equivalent sphere diameter distribution of all silver halide grains of the emulsion were 0.40 μm and 23%, respectively.

s) Preparation of Emulsion Em-19:

Emulsion Em-19 as a comparative example was prepared in the same manner as emulsion Em-15, except that the amounts of KBr and KI in the halogen solution were changed so that the iodine content became 21.0 mol %.

Desired {100} tabular grains having an aspect ratio of at least 2 were not obtained by the above process.

t) Preparation of Emulsion Em-20:

Emulsion Em-20 was prepared in the same manner as emulsion Em-15 except that the temperature, silver amount and potential at the grain formation were appropriately changed.

As a result of observation of the TEM image of a replica of emulsion grains, it was found that 95% of the total projected area of all of AgX grains prepared by the above process were occupied by tabular grains having principal planes composed of {100} faces, and the average aspect ratio was 3.9. The average equivalent sphere diameter, variation coefficient of the equivalent sphere diameter distribution and average I content of all silver halide grains of the emulsion were 0.32 μm, 22% and 4 mol %, respectively.

u) Preparation of Emulsion Em-21:

Emulsion Em-21 was prepared in the same manner as emulsion Em-15 except that the temperature, silver amount and potential at the grain formation were appropriately changed.

As a result of observation of the TEM image of a replica of emulsion grains, it was found that 95% of the total projected area of all of AgX grains prepared by the above process were occupied by tabular grains having principal planes composed of {100} faces, and the average aspect ratio was 3.8. The average equivalent sphere diameter, variation coefficient of the equivalent sphere diameter distribution and average I content of all silver halide grains of the emulsion were 0.25 μm, 22% and 4 mol %, respectively.

v) Preparation of Emulsion Em-22:

Emulsion Em-22 was prepared in the same manner as emulsion Em-15 except that the temperature, silver amount and potential at the grain formation were appropriately changed.

As a result of observation of the TEM image of a replica of emulsion grains, it was found that 95% of the total projected area of all of AgX grains prepared by the above process were occupied by tabular grains having principal planes composed of {100} faces, and the average aspect ratio was 3.8. The average equivalent sphere diameter, variation coefficient of the equivalent sphere diameter distribution and average I content of all silver halide grains of the emulsion were 0.20 μm, 24% and 4 mol %, respectively.

w) Preparation of Emulsion Em-23:

Emulsion Em-23 was prepared in the same manner as emulsion Em-15 except that the temperature, silver amount and potential at the grain formation were appropriately changed.

As a result of observation of the TEM image of a replica of emulsion grains, it was found that 96% of the total projected area of all of AgX grains prepared by the above process were occupied by tabular grains having principal planes composed of {100} faces, and the average aspect ratio was 4.0. The average equivalent sphere diameter, variation coefficient of the equivalent sphere diameter distribution and average I content of all silver halide grains of the emulsion were 0.50 μm, 21% and 4 mol %, respectively.

x) Preparation of Emulsion Em-24:

Emulsion Em-24 was prepared in the same manner as emulsion Em-15 except that the temperature, silver amount and potential at the grain formation were appropriately changed.

As a result of observation of the TEM image of a replica of emulsion grains, it was found that 95% of the total projected area of all of AgX grains prepared by the above process were occupied by tabular grains having principal planes composed of {100} faces, and the average aspect ratio was 4.1. The average equivalent sphere diameter, variation coefficient of the equivalent sphere diameter distribution and average I content of all silver halide grains of the emulsion were 0.63 μm, 20% and 4 mol %, respectively.

y) Preparation of Emulsion Em-25:

Emulsion Em-25 was prepared in the same manner as emulsion Em-15 except that the temperature, silver amount and potential at the grain formation were appropriately changed.

As a result of observation of the TEM image of a replica of emulsion grains, it was found that 96% of the total projected area of all of AgX grains prepared by the above process were occupied by tabular grains having principal planes composed of {100} faces, and the average aspect ratio was 4.1. The average equivalent sphere diameter, variation coefficient of the equivalent sphere diameter distribution and average I content of all silver halide grains of the emulsion were 0.79 μm, 19% and 4 mol %, respectively.

z) Preparation of Emulsion Em-26:

Emulsion Em-26 was prepared in the same manner as emulsion Em-15 except that the temperature, silver amount and potential at the grain formation were appropriately changed.

As a result of observation of the TEM image of a replica of emulsion grains, it was found that 96% of the total projected area of all of AgX grains prepared by the above process were occupied by tabular grains having principal planes composed of {100} faces, and the average aspect ratio was 4.2. The average equivalent sphere diameter, variation coefficient of the equivalent sphere diameter distribution and average I content of all silver halide grains of the emulsion were 1.00 μm, 19% and 4 mol %, respectively.

The thus obtained emulsions Em-1 to Em-26 were chemically sensitized by adding spectral sensitizing dye S-4 set forth below, potassium thiocyanate, potassium chloroaurate, sodium thiosulfate and N,N-dimethylselenourea as a selenium sensitizer under conditions such that the temperature, pH and pAg were 60° C., 6.20 and 8.40, respectively so that the 1/100 sec sensitivity became the maximum.

The characteristics of the emulsions Em-1 to Em-26 are listed in Table 1.

TABLE 1

Characteristics of Em-1 to Em-26

| Emulsion (Remarks) | Grain size (equivalent spherical diameter/μm) | Coefficient of distribution of grain size (%) | Aspect ratio | Iodide content (mol %) | Main plane | Ratio of {100} tabular grains ({100} plane ratio ≧ 80%) in the emulsion |
|---|---|---|---|---|---|---|
| Em-1 (Comp.) | 0.40 | 21 | 4.0 | 4.0 | {111} | — |
| Em-2 (Comp.) | 0.20 | 24 | 3.8 | 4.0 | {111} | — |
| Em-3 (Comp.) | 0.25 | 23 | 3.9 | 4.0 | {111} | — |
| Em-4 (Comp.) | 0.32 | 23 | 3.9 | 4.0 | {111} | — |
| Em-5 (Comp.) | 0.63 | 20 | 4.1 | 4.0 | {111} | — |
| Em-6 (Comp.) | 0.50 | 21 | 4.0 | 4.0 | {111} | — |
| Em-7 (Comp.) | 0.79 | 20 | 4.2 | 4.0 | {111} | — |
| Em-8 (Comp.) | 1.00 | 19 | 4.1 | 4.0 | {111} | — |
| Em-9 (Comp.) | 0.40 | 33 | 3.8 | 4.0 | {100} | 51 |
| Em-10 (Comp.) | 0.40 | 24 | 4.1 | 4.0 | {100} | 54 |
| Em-11 (Comp.) | 0.40 | 30 | 4.2 | 4.0 | {100} | 65 |
| Em-12 (Comp.) | 0.40 | 29 | 4.1 | 4.0 | {100} | 71 |
| Em-13 (Inv.) | 0.40 | 22 | 4.2 | 4.0 | {100} | 82 |
| Em-14 (Inv.) | 0.40 | 20 | 4.0 | 4.0 | {100} | 86 |
| Em-15 (Inv.) | 0.40 | 19 | 4.2 | 4.0 | {100} | 96 |
| Em-16 (Inv.) | 0.40 | 18 | 4.1 | 4.0 | {100} | 95 |
| Em-17 (Comp.) | 0.40 | 17 | 4.5 | 0 | {100} | 96 |
| Em-18 (Inv.) | 0.40 | 23 | 3.3 | 10.0 | {100} | 82 |
| Em-19 (Comp.) | 0.40 | 24 | — | 21.0 | No {100} tabular grain aimed was formed | |
| Em-20 (Inv.) | 0.32 | 22 | 3.9 | 4.0 | {100} | 95 |
| Em-21 (Inv.) | 0.25 | 22 | 3.8 | 4.0 | {100} | 95 |
| Em-22 (Inv.) | 0.20 | 24 | 3.8 | 4.0 | {100} | 95 |
| Em-23 (Inv.) | 0.50 | 21 | 4.0 | 4.0 | {100} | 96 |
| Em-24 (Comp.) | 0.63 | 20 | 4.1 | 4.0 | {100} | 95 |
| Em-25 (Comp.) | 0.79 | 19 | 4.1 | 4.0 | {100} | 96 |
| Em-26 (Comp.) | 1.00 | 19 | 4.1 | 4.0 | {100} | 96 |

(2) Preparation of Coated Sample 101:

A multilayered color lightsensitive material comprising a support of 127 μm-thick undercoated cellulose triacetate film and, superimposed thereon, layers of the following compositions was prepared and designated sample 101. The value indicates the addition amount per square meter. Each effect of the added compounds are not limited to the use described below.

| | |
|---|---|
| 1st layer (antihalation layer) | |
| black colloidal silver | 0.10 g |
| gelatin | 1.90 g |
| ultraviolet absorbent U-1 | 0.10 g |
| ultraviolet absorbent U-3 | 0.040 g |
| ultraviolet absorbent U-4 | 0.10 g |
| high b.p. org. solvent oil-1 | 0.10 g |
| microcrystalline solid dispersion of dye E-1 | 0.10 g |
| 2nd layer (interlayer) | |
| gelatin | 0.40 g |
| compound Cpd-C | 5.0 mg |
| compound Cpd-J | 5.0 mg |
| compound Cpd-K | 3.0 mg |
| high b.p. org. solvent oil-3 | 0.10 g |
| dye D-4 | 0.80 mg |
| 3rd layer (interlayer) | |
| surface and interior fogged fine grain silver iodobromide emulsion (av. grain size 0.06 μm, var. coeff. 18%, AgI cont. 1 mol %) | Ag qty. 0.050 g |
| yellow colloidal silver | Ag qty. 0.030 g |
| gelatin | 0.40 g |
| 4th layer (low-speed red-sensitive emulsion layer) | |
| emulsion A | Ag qty. 0.30 g |

-continued

| | |
|---|---|
| emulsion B | Ag qty. 0.20 g |
| gelatin | 0.80 g |
| coupler C-1 | 0.15 g |
| coupler C-2 | 0.050 g |
| coupler C-3 | 0.050 g |
| coupler C-9 | 0.050 g |
| compound Cpd-C | 5.0 mg |
| compound Cpd-J | 5.0 mg |
| high b.p. org. solvent oil-2 | 0.10 g |
| additive P-1 | 0.10 g |
| 5th layer (medium-speed red-sensitive emulsion layer) | |
| emulsion C | Ag qty. 0.50 g |
| gelatin | 0.80 g |
| coupler C-1 | 0.20 g |
| coupler C-2 | 0.050 g |
| coupler C-3 | 0.20 g |
| high b.p. org. solvent oil-2 | 0.10 g |
| additive P-1 | 0.10 g |
| 6th layer (high-speed red-sensitive emulsion layer) | |
| emulsion D | Ag qty. 0.40 g |
| gelatin | 1.10 g |
| coupler C-1 | 0.30 g |
| coupler C-2 | 0.10 g |
| coupler C-3 | 0.70 g |
| additive P-1 | 0.10 g |
| 7th layer (interlayer) | |
| gelatin | 0.60 g |
| additive M-1 | 0.30 g |
| color mixing inhibitor Cpd-I | 2.6 mg |
| dye D-5 | 0.020 g |
| dye D-6 | 0.010 g |
| compound Cpd-J | 5.0 mg |
| high b.p. org. solvent oil-1 | 0.020 g |
| 8th layer (interlayer) | |

-continued

| | |
|---|---|
| surface and interior fogged silver iodobromide emulsion (av. grain size 0.06 μm, var. coeff. 16%, AgI cont. 0.3 mol %) | Ag qty. 0.020 g |
| yellow colloidal silver | Ag qty. 0.020 g |
| gelatin | 1.00 g |
| additive P-1 | 0.20 g |
| color mixing inhibitor Cpd-A | 0.10 g |
| compound Cpd-C | 0.10 g |
| 9th layer (low-speed green-sensitive emulsion layer) | |
| emulsion Em-1 | Ag qty. 0.50 g |
| gelatin | 0.50 g |
| coupler C-4 | 0.10 g |
| coupler C-7 | 0.050 g |
| coupler C-8 | 0.10 g |
| compound Cpd-B | 0.030 g |
| compound Cpd-D | 0.020 g |
| compound Cpd-E | 0.020 g |
| compound Cpd-F | 0.040 g |
| compound Cpd-J | 10 mg |
| compound Cpd-L | 0.020 g |
| high b.p. org. solvent oil-1 | 0.10 g |
| high b.p. org. solvent oil-2 | 0.10 g |
| 10th layer (medium-speed green-sensitive emulsion layer) | |
| emulsion F | Ag qty. 0.40 g |
| gelatin | 0.60 g |
| coupler C-4 | 0.070 g |
| coupler C-7 | 0.050 g |
| coupler C-8 | 0.050 g |
| compound Cpd-B | 0.030 g |
| compound Cpd-D | 0.020 g |
| compound Cpd-E | 0.020 g |
| compound Cpd-F | 0.050 g |
| compound Cpd-L | 0.050 g |
| high b.p. org. solvent oil-2 | 0.010 g |
| high b.p. org. solvent oil-4 | 0.050 g |
| 11th layer (high-speed green-sensitive emulsion layer) | |
| emulsion G | Ag qty. 0.50 g |
| gelatin | 1.00 g |
| coupler C-4 | 0.20 g |
| coupler C-7 | 0.10 g |
| coupler C-8 | 0.050 g |
| compound Cpd-B | 0.080 g |
| compound Cpd-E | 0.020 g |
| compound Cpd-F | 0.040 g |
| compound Cpd-K | 5.0 mg |
| compound Cpd-L | 0.020 g |
| high b.p. org. solvent oil-1 | 0.020 g |
| high b.p. org. solvent oil-2 | 0.020 g |
| 12th layer (interlayer) | |
| gelatin | 0.60 g |
| compound Cpd-L | 0.050 g |
| high b.p. org. solvent oil-1 | 0.050 g |
| 13th layer (yellow filter layer) | |
| yellow colloidal silver | Ag qty. 0.020 g |
| gelatin | 1.10 g |
| color mixing inhibitor Cpd-A | 0.010 g |
| compound Cpd-L | 0.010 g |
| high b.p. org. solvent oil-1 | 0.010 g |
| microcrystalline solid dispersion of dye E-2 | 0.030 g |
| microcrystalline solid dispersion of dye E-3 | 0.020 g |
| 14th layer (interlayer) | |
| gelatin | 0.60 g |
| 15th layer (low-speed blue-sensitive emulsion layer) | |
| emulsion H | Ag qty. 0.20 g |
| emulsion I | Ag qty. 0.30 g |
| gelatin | 0.80 g |

-continued

| | |
|---|---|
| coupler C-5 | 0.20 g |
| coupler C-6 | 0.10 g |
| coupler C-10 | 0.40 g |
| 16th layer (medium-speed blue-sensitive emulsion layer) | |
| emulsion J | Ag qty. 0.50 g |
| gelatin | 0.90 g |
| coupler C-5 | 0.10 g |
| coupler C-6 | 0.10 g |
| coupler C-10 | 0.60 g |
| 17th layer (high-speed blue-sensitive emulsion layer) | |
| emulsion K | Ag qty. 0.40 g |
| gelatin | 1.20 g |
| coupler C-5 | 0.10 g |
| coupler C-6 | 0.10 g |
| coupler C-10 | 0.60 g |
| high b.p. org. solvent oil-2 | 0.10 g |
| 18th layer (1st protective layer) | |
| gelatin | 0.70 g |
| ultraviolet absorbent U-1 | 0.20 g |
| ultraviolet absorbent U-2 | 0.050 g |
| ultraviolet absorbent U-5 | 0.30 g |
| compound Cpd-G | 0.050 g |
| formaldehyde scavenger compound Cpd-H | 0.40 g |
| dye D-1 | 0.15 g |
| dye D-2 | 0.050 g |
| dye D-3 | 0.10 g |
| high b.p. org. solvent oil-3 | 0.10 g |
| 19th layer (2nd protective layer) | |
| yellow colloidal silver | Ag qty. 0.10 mg |
| fine grain silver iodobromide emulsion (av. grain size 0.06 μm, AgI cont. 1 mol %) | Ag qty. 0.10 g |
| gelatin | 0.40 g |
| 20th layer (3rd protective layer) | |
| gelatin | 0.40 g |
| polymethyl methacrylate (av. grain size 1.5 μm) | 0.10 g |
| methyl methacrylate/acrylic acid 4:6 copolymer (av. grain size 1.5 μm) | 0.10 g |
| silicone oil So-1 | 0.030 g |
| surfactant W-1 | 3.0 mg |
| surfactant W-2 | 0.030 g |

All the above emulsion layers were doped with additives F-1 to F-8 in addition to the above components, and, further, the layers were doped with gelatin hardener H-1 and surfactants for emulsification and coating W-3, W-4, W-5 and W-6 in addition to the above components.

Moreover, phenol, 1,2-benzisothiazolin-3-one, 2-phenoxyethanol, phenethyl alcohol and butyl p-benzoate were added as antiseptic and mildewproofing agents.

Preparation of dispersion of organic solid disperse dye:

The Dye E-1 was dispersed by the following method. Illustratively, water and 200 g of Pluronic F88 (trade name for ethylene oxide/propylene oxide block copolymer) produced by BASF were added to 1430 g of dye wet cake containing 30% of methanol and agitated, thereby obtaining a slurry having a dye content of 6%. 1700 mL of zirconia beads having an average grain size of 0.5 mm were charged into Ultraviscomill (UVM-2) manufactured by Aimex Co., Ltd. and the slurry was milled at a peripheral speed of about 10 m/sec and a delivery of 0.5 L/min for 8 hr. The beads were removed by filtration and the slurry was diluted with water into a dye content of 3%. The dilution was heated at 90° C. for 10 hr for stabilization. The obtained dye fine grains had an average grain size of 0.60 μm and a grain size distribution breadth (standard deviation of grain sizes×100/average grain size) of 18%.

Solid dispersions of the dyes E-2, E-3 were obtained in the same manner. The average grain sizes thereof were 0.54 μm and 0.56 μm, respectively.

The silver halide emulsions and dyes incorporated therein which were used in sample 101 are listed in Tables 2 and 3.

TABLE 2

Characteristics of grains used in examples

| Emulsion | Grain shape | Equivalent spherical diameter (μm) | Coefficient of grain size distribution (%) | AgI content (mol %) | Habit of main planes |
|---|---|---|---|---|---|
| A | Tabular grains Av. asp. rt.*: 5.0 | 0.40 | 25 | 3.5 | {111} |
| B | Internally fogged tabular grains Av. asp. rt.*: 5.0 | 0.50 | 25 | 3.5 | {111} |
| C | Tabular grains Av. asp. rt.*: 8.0 | 0.62 | 25 | 3.0 | {111} |
| D | Tabular grains Av. asp. rt.*: 8.0 | 1.04 | 10 | 1.6 | {111} |
| Em-1 | Tabular grains Av. asp. rt.*: 4.0 | 0.40 | 21 | 4.0 | {111} |
| F | Tabular grains Av. asp. rt.*: 8.0 | 0.66 | 15 | 3.2 | {111} |
| G | Tabular grains Av. asp. rt.*: 10 | 1.20 | 8 | 2.8 | {111} |
| H | Tabular grains Av. asp. rt.*: 5.0 | 0.42 | 20 | 4.6 | {111} |
| I | Tabular grains Av. asp. rt.*: 8.0 | 0.71 | 15 | 4.6 | {111} |
| J | Tabular grains Av. asp. rt.*: 8.0 | 0.71 | 8 | 2.0 | {111} |
| K | Tabular grains Av. asp. rt.*: 10 | 1.30 | 8 | 1.0 | {111} |

Note*: Av. asp. rt. signifies average aspect ratio.

TABLE 3

Spectral sensitization of each emulsion used in examples

| Emulsion | Spectral sensitizing dye added | Addition amount of sensitizing dye per mol of silver halide (g) |
|---|---|---|
| A | S-3 | 0.025 |
| | S-2 | 0.40 |
| | S-1 | 0.01 |
| B | S-3 | 0.01 |
| | S-2 | 0.40 |
| C | S-3 | 0.01 |
| | S-2 | 0.30 |
| | S-1 | 0.10 |
| D | S-3 | 0.01 |
| | S-2 | 0.15 |
| | S-1 | 0.10 |
| | S-8 | 0.01 |
| Em-1 | S-4 | 0.5 |
| F | S-4 | 0.40 |
| | S-9 | 0.1 |
| G | S-4 | 0.30 |
| | S-5 | 0.08 |
| | S-9 | 0.05 |
| H | S-4 | 0.25 |
| | S-5 | 0.06 |
| | S-9 | 0.05 |
| I | S-6 | 0.07 |
| | S-7 | 0.45 |
| J | S-6 | 0.05 |
| | S-7 | 0.30 |
| K | S-6 | 0.05 |
| | S-7 | 0.25 |

C-1

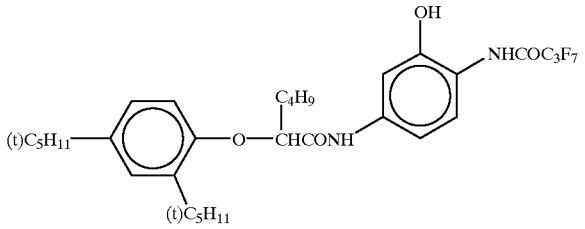

C-2

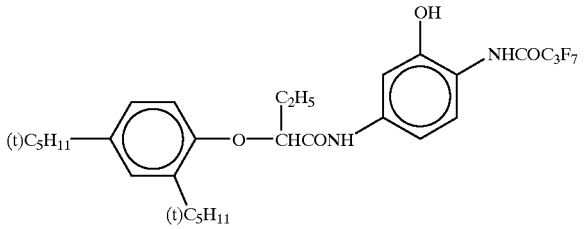

-continued
C-3
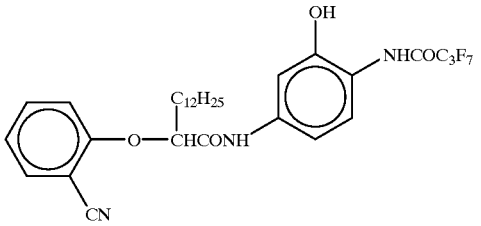
C-4
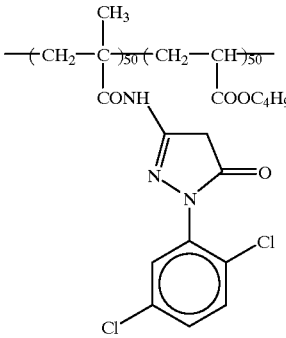
The numbers are expressed in wt. %
Average molecular weight: about 25,000
C-5
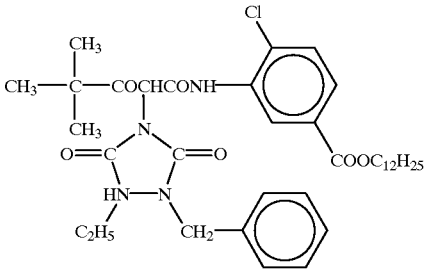
C-6
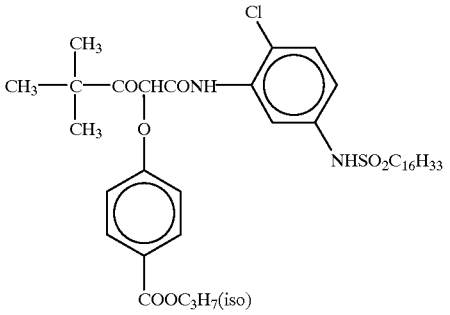
C-7
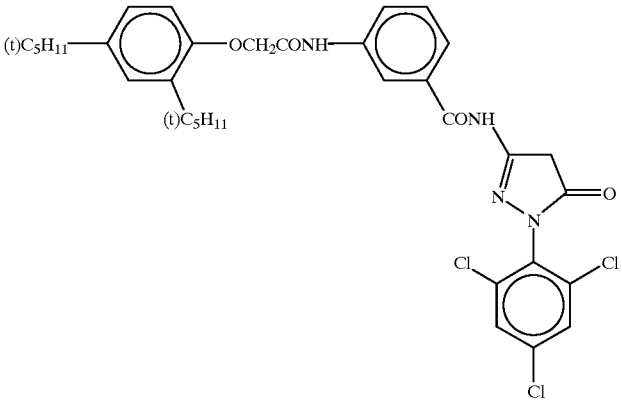
C-8
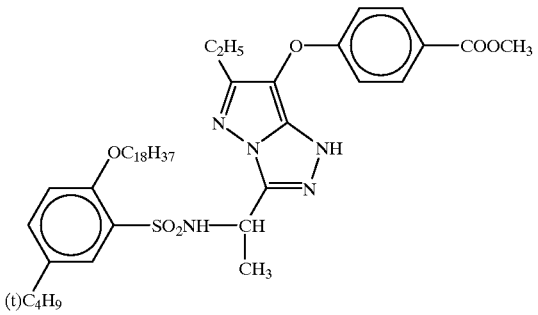

-continued
C-9
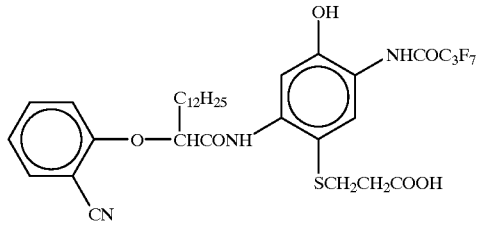
C-10
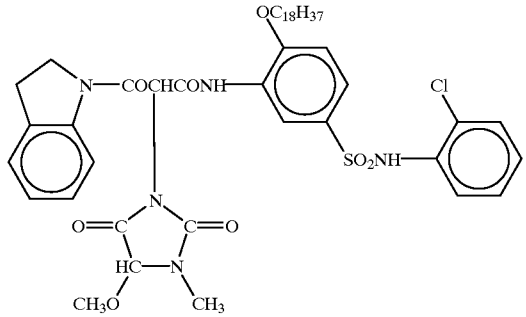
Oil-1
Dibutyl phthalate
Oil-2
Tricresyl phosphate
Oil-3
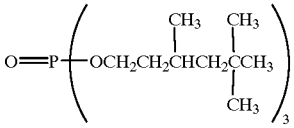
Oil-4
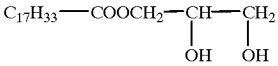
Cpd-A
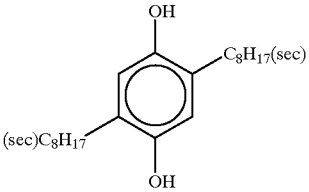
Cpd-B
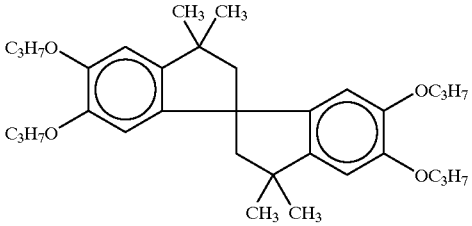
Cpd-C
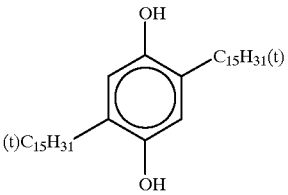
Cpd-D
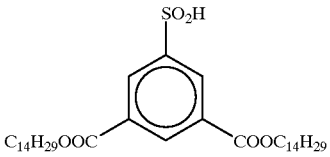
Cpd-E
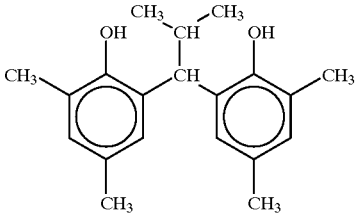
Cpd-F
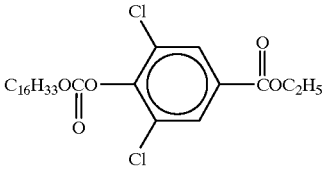

-continued
Cpd-G
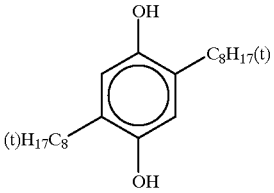
Cpd-H
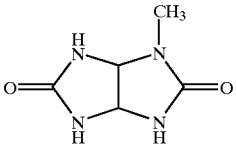
Cpd-I
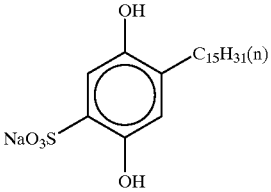
Cpd-J
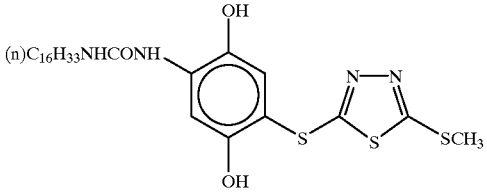
Cpd-K
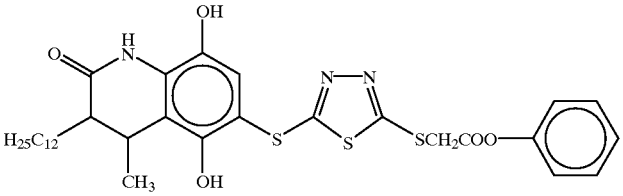
Cpd-L
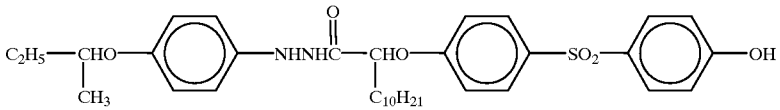
U-I
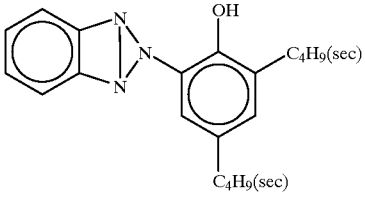
U-2
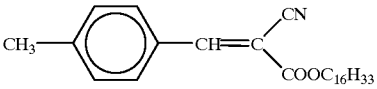
U-3
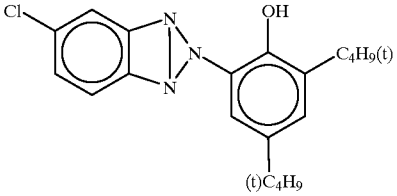
U-4
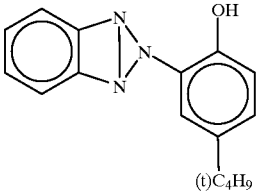
U-5
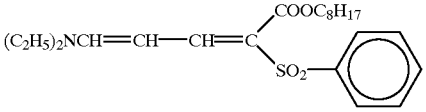
S-1
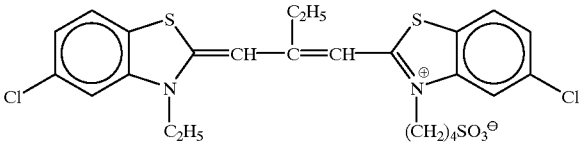

-continued
S-2
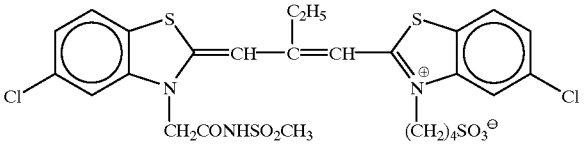
S-3
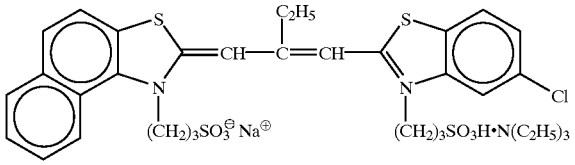
S-4
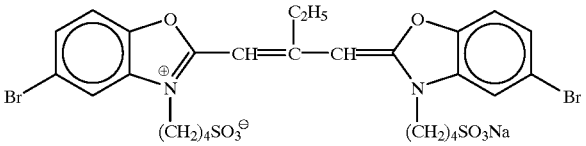
S-5
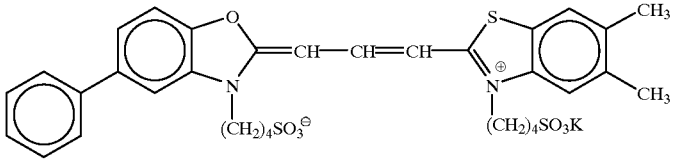
S-6
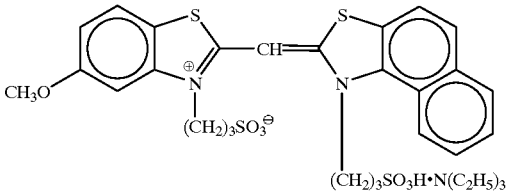
S-7
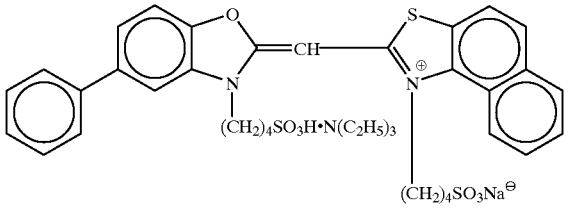
S-8
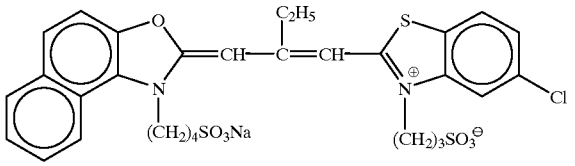
S-9
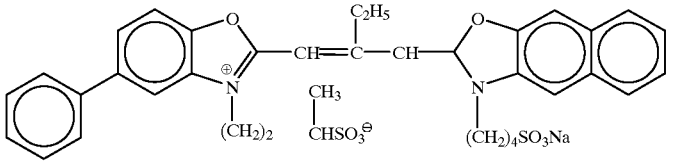

-continued
D-1
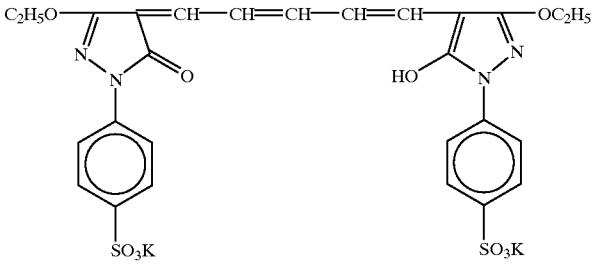
D-2
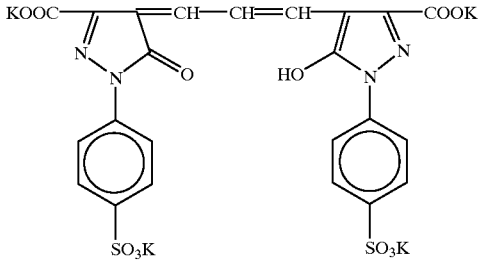
D-3
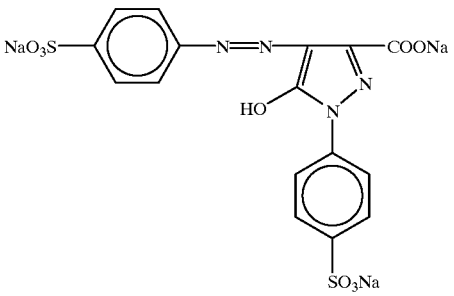
D-4
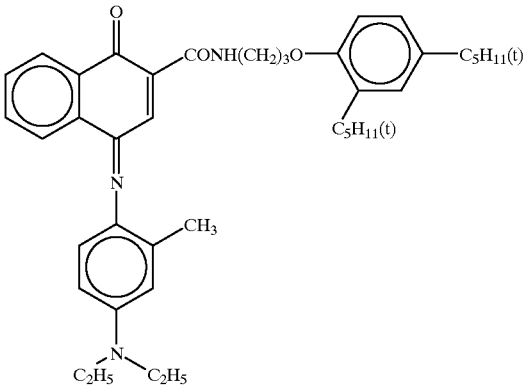
D-5
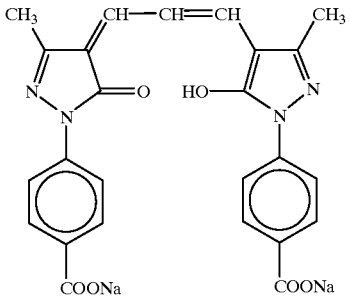
D-6
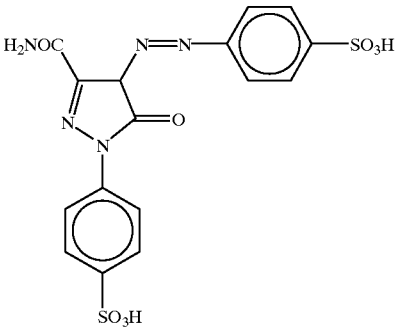
E-1
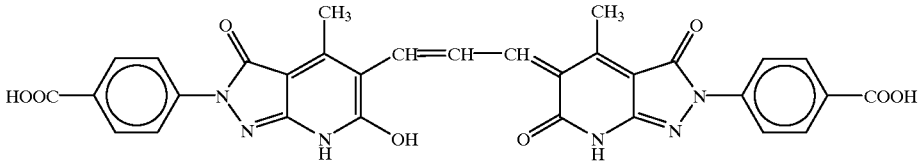

-continued
E-2
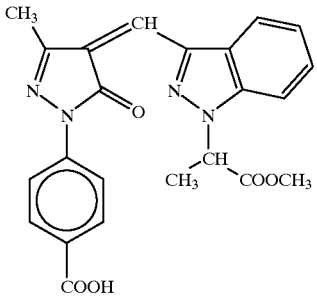
E-3
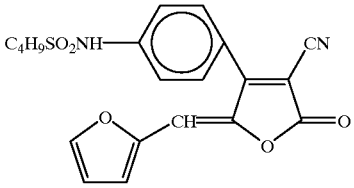
H-1
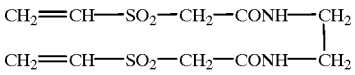
W-1
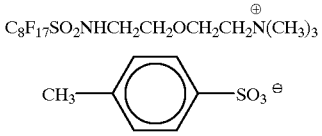
W-2
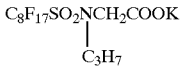
W-3
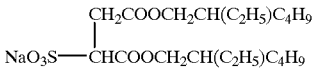
W-4
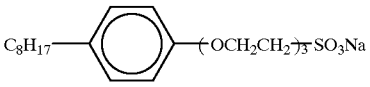
W-5
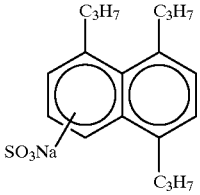
W-6
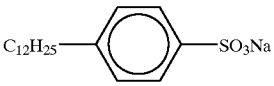
P-1
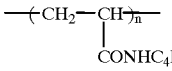
n = 100–1,000
M-1
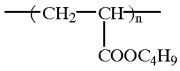
n = 100–1,000
So-1
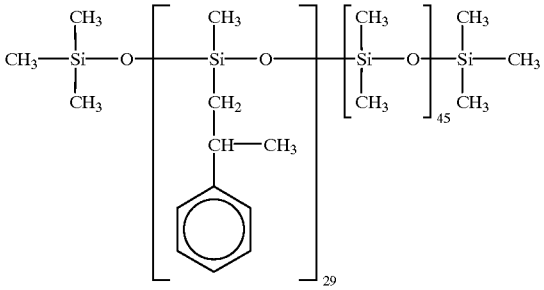
F-1
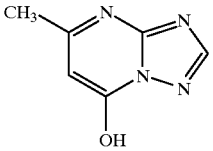
F-2
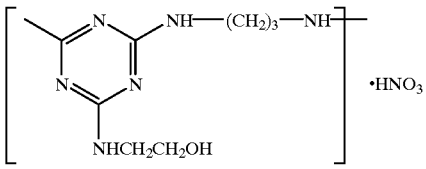
(n = 3–4)

-continued

F-3

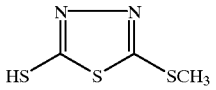

F-4

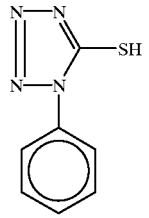

F-5

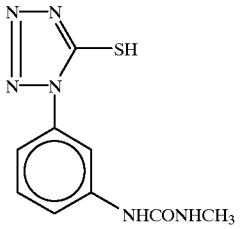

F-6

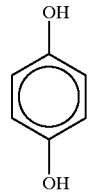

F-7

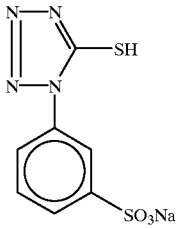

F-8

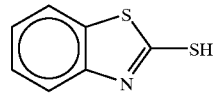

(3) Preparation of Samples 102 to 112 and Evaluation Thereof:

Samples 102 to 112 were prepared in the same manner as sample 101 except that the emulsion Em-1 used in the 9th layer was replaced by each one of the emulsions Em-9 to Em-19, respectively.

(i) Photographic Performance:

Each of the above samples was subjected to a 1/100 sec wedge exposure using a white light source and developed in the following manner. Fresh (prior to storage test) photographic properties (sensitivity, gradation at a highlight portion) were evaluated by sensitometry.

With respect to the samples 101 to 112, the sensitivity of the 9th layer was estimated from the inverse number of an exposure imparting a magenta density of 0.5.

(ii) Photographic Gradation:

Evaluation was made relative to the comparative sample 101. The comparative sample 101 was assigned reference value 100, and, as compared with the same, a soft gradation was assigned a value of less than 100 and an identical or hard gradation was assigned a value of 100 or more. The value of 100 or more indicates a high contrast and an excellence in emulsion performance.

(iii) Latent Image Preservability:

With respect to the coated samples 101 to 112, three sets of test pieces were prepared and subjected to a 1/100 sec wedge exposure. The first set was stored at 50° C. in 30% RH for 3 days. The second set was stored at 50° C. in 80% RH for 3 days. The third set was stored in a freezer and used as a control. All the sets were processed and subjected to sensitometry in the same manner as in item (i) above. Thus, sensitivity changes were determined and compared with each other. The closer to 100 the value, the less the property change after preservation to thereby ensure a performance excellence.

(iv) RMS Granularity:

The RMS granularity at a magenta density of 0.5 was measured of each of the processed strips of samples 101 to 112. The RMS granularity of sample 101 was assigned a value of 100 and the measurements were expressed relative to the same. The smaller the value, the more desirable the granularity.

Processing steps and processing solutions of standard developing treatment:

| Step | Time (min) | Temp. (° C.) | Tank vol. (L) | Replenishment rate (mL/m$^2$) |
|---|---|---|---|---|
| 1st. development | 6 | 38 | 12 | 2200 |
| water washing | 2 | 38 | 4 | 7500 |
| reversal | 2 | 38 | 4 | 1100 |
| color development | 6 | 38 | 12 | 2200 |
| prebleaching | 2 | 38 | 4 | 1100 |
| bleaching | 6 | 38 | 12 | 220 |
| fixing | 4 | 38 | 8 | 1100 |
| water washing | 4 | 38 | 8 | 7500 |
| final rinse | 1 | 25 | 2 | 1100 |

The composition of each processing solution was as follows:

| (1st development solution) | Tank soln. | Replenisher |
|---|---|---|
| pentasodium nitrilo-N,N,N-trimethylenephosphonate | 1.5 g | 1.5 g |
| pentasodium diethylenetri- | 2.0 g | 2.0 g |

-continued

| (1st development solution) | Tank soln. | Replenisher |
|---|---|---|
| aminepentacetate | | |
| sodium sulfite | 30 g | 30 g |
| potassium hydroquinone-monosulfonate | 20 g | 20 g |
| potassium carbonate | 15 g | 20 g |
| sodium bicarbonate | 12 g | 15 g |
| 1-phenyl-4-methyl-4-hydroxy-methyl-3-pyrazolidone | 1.5 g | 2.0 g |
| potassium bromide | 2.5 g | 1.4 g |
| potassium thiocyanate | 1.2 g | 1.2 g |
| potassium iodide | 2.0 mg | — |
| diethylene glycol | 13 g | 15 g |
| water | q.s. ad 1000 mL | q.s. ad 1000 mL |
| pH | 9.60 | 9.60 |

This pH was adjusted by the use of sulfuric acid or potassium hydroxide.

| (reversal solution) | Tank soln. | Replenisher |
|---|---|---|
| pentasodium nitrilo-N,N,N-trimethylenephosphonate | 3.0 g | same as left |
| stannous chloride dihydrate | 1.0 g | " |
| p-aminophenol | 0.1 g | " |
| sodium hydroxide | 8 g | " |
| glacial acetic acid | 15 mL | " |
| water | q.s. ad 1000 mL | " |
| pH | 6.00 | " |

This pH was adjusted by the use of acetic acid or sodium hydroxide.

| (Color developer) | Tank soln. | Replenisher |
|---|---|---|
| pentasodium nitrilo-N,N,N-trimethylenephosphonate | 2.0 g | 2.0 g |
| sodium sulfite | 7.0 g | 7.0 g |
| trisodium phosphate dodeca hydrate | 36 g | 36 g |
| potassium bromide | 1.0 g | — |
| potassium iodide | 90 mg | — |
| sodium hydroxide | 3.0 g | 3.0 g |
| citrazinic acid | 1.5 g | 1.5 g |
| N-ethyl-N-(β-methanesulfon-amido-ethyl)-3-methyl-4-aminoaniline 3/2 sulfate monohydrate | 11 g | 11 g |
| 3,6-dithiaoctane-1,8-diol | 1.0 g | 1.0 g |
| water | q.s. ad 1000 mL | q.s. ad 1000 mL |
| pH | 11.80 | 12.00 |

This pH was adjusted by the use of sulfuric acid or potassium hydroxide.

| (Prebleaching) | Tank soln. | Replenisher |
|---|---|---|
| disodium ethylenediamine-tetraacetate dihydrate | 8.0 g | 8.0 g |
| sodium sulfite | 6.0 g | 8.0 g |
| 1-thioglycerol | 0.4 g | 0.4 g |
| formaldehyde/sodium bisulfite adduct | 30 g | 35 g |
| water | q.s. ad 1000 mL | q.s. ad 1000 mL |
| pH | 6.30 | 6.10 |

-continued

This pH was adjusted by the use of acetic acid or sodium hydroxide.

| (Bleaching soln.) | Tank soln. | Replenisher |
|---|---|---|
| disodium ethylenediamine-tetraacetate dihydrate | 2.0 g | 4.0 g |
| Fe(III) ammonium ethylene-diaminetetraacetate dihydrate | 120 g | 240 g |
| potassium bromide | 100 g | 200 g |
| ammonium nitrate | 10 g | 20 g |
| water | q.s. ad 1000 mL | q.s. ad 1000 mL |
| pH | 5.70 | 5.50 |

This pH was adjusted by the use of nitric acid or sodium hydroxide.

| (Fixing solution) | Tank soln. | Replenisher |
|---|---|---|
| ammonium thiosulfate | 80 g | same as left |
| sodium sulfite | 5.0 g | " |
| sodium bisulfite | 5.0 g | " |
| water | q.s. ad 1000 mL | " |
| pH | 6.60 | " |

This pH was adjusted by the use of acetic acid or aqueous ammonia.

| (Final rinse) | Tank soln. | Replenisher |
|---|---|---|
| 1,2-benzoisothiazolin-3-one | 0.02 g | 0.03 g |
| polyoxyethylene p-mononyl phenyl ether (av. deg. of polymn. 10) | 0.3 g | 0.3 g |
| polymaleic acid (av. mol. wt. 2,000) | 0.1 g | 0.15 g |
| water | q.s. ad 1000 mL | q.s. ad 1000 mL |
| pH | 7.0 | 7.0 |

The results are given in Table 4.

TABLE 4

| Sample No. | Sensitivity[1)] | Preservability of latent image[2)] 50° C., 30% RH | 50° C., 80% RH | RMS granularity[3)] | Emulsion used in 9th layer | Evaluation of graduation[4)] | Remarks |
|---|---|---|---|---|---|---|---|
| 101 | 100 | 70 | 61 | 100 | Em-1 | 100 | Comp. |
| 102 | 92 | 72 | 63 | 104 | Em-9 | 65 | Comp. |
| 103 | 98 | 71 | 61 | 106 | Em-10 | 85 | Comp. |
| 104 | 94 | 75 | 66 | 105 | Em-11 | 76 | Comp. |
| 105 | 98 | 73 | 64 | 106 | Em-12 | 77 | Comp. |
| 106 | 115 | 80 | 70 | 99 | Em-13 | 101 | Inv. |
| 107 | 114 | 82 | 72 | 98 | Em-14 | 102 | Inv. |
| 108 | 124 | 83 | 74 | 99 | Em-15 | 103 | Inv. |
| 109 | 125 | 82 | 73 | 99 | Em-16 | 103 | Inv. |
| 110 | 105 | 84 | 75 | 110 | Em-17 | 102 | Comp. |
| 111 | 116 | 77 | 70 | 95 | Em-18 | 100 | Inv. |
| 112 | 85 | 69 | 63 | 90 | Em-19 | 45 | Comp. |

[1)]Each sensitivity is expressed in a relative value, assuming that of Sample 101 as 100.
[2)]Preservability is expressed in a relative value, assuming the sensitivity of the sample preserved in a freezer as 100.
[3)]Each RMS granularity is expressed in a relative value, assuming that of Sample 101 as 100.
[4)]Evaluation was performed at a portion of magenta highlight.

As apparent from the results in Table 4, the performance of the {100} tabular emulsion according to the present invention excels that of the conventional {111} tabular emulsion.

Further, surprisingly, it has been found that the samples including the emulsion of the present invention exhibit excellent latent image preservability.

Similar investigations were also conducted with respect to a red-sensitive emulsion and a blue-sensitive emulsion. With respect to both the emulsion systems, similar desirable results were attained.

(4) Preparation of Coated Samples 201 to 216 and Evaluation Thereof:

Dodecylbenzenesulfonate as a coating aid, a p-vinylbenzenesulfonate as a thickening agent and a vinyl sulfone compound as a hardening agent were added to each of the emulsions Em-1 to Em-8, Em-15 and Em-20 to Em-26 obtained in item (1) above, thereby obtaining emulsion coating solutions. Subsequently, each of the obtained emulsion coating solutions were separately uniformly applied onto each undercoated polyester base and a surface protective layer composed mainly of an aqueous gelatin solution was applied thereonto. Thus, there were prepared coated samples 201 to 216. The amount of applied silver of each of the samples 201 to 216, the amount of applied gelatin of each of the protective layers and the amount of applied gelatin of each of the emulsion layers were 3.0, 1.3 and 2.7 g/m$^2$, respectively.

The following experiment was conducted for evaluating the performance of each coated sample thus obtained.

(i) Photographic Performance:

Pieces of the coated samples 201 to 216 were subjected to a wedge exposure conducted at an exposure value of 50 CMS and at an exposure duration of 1/100 sec, simultaneously developed with a processing solution of the below specified composition at 20° C. for 4 min and sequentially subjected to fixing, water washing, drying, and then sensitometry. The sensitivity thereof was determined by measuring an exposure value imparting a density of fog+0.1 and calculating the inverse number of the exposure value.

(ii) RMS Granularity:

The RMS granularity at V density (density of developed silver) of 0.5 of each processed sample was measured.

The ratio of sensitivity/granularity of each of the samples 210 to 216 was determined on the basis of the results obtained in items (i) and (ii) above.

| (Processing solution) | |
|---|---|
| 1-phenyl-3-pyrazolidone | 0.5 g |
| hydroquinone | 10 g |
| disodium ethylenediamine-tetraacetate | 2 g |
| potassium sulfite | 60 g |
| boric acid | 4 g |
| potassium carbonate | 20 g |
| sodium bromide | 5 g |
| diethylene glycol | 20 g |
| water | q.s. ad 1 L |
| pH (adjusted with sodium hydroxide) | 10.0 |

The obtained results are summarized in Table 5.

TABLE 5

| Grain size | Main plane | | | | | |
|---|---|---|---|---|---|---|
| Equivalent | {111} | | | {100} | | |
| Sample No. | spherical diameter/ μm | Emulsion used | Sensitivity/ granularity ratio* | Sample No. | Emulsion used | Sensitivity/ granularity ratio* |
| 201 | 0.20 | Em-2 | 20 | 209 | Em-22 | 45 |
| 202 | 0.25 | Em-3 | 29 | 210 | Em-21 | 50 |
| 203 | 0.32 | Em-4 | 39 | 211 | Em-20 | 56 |
| 204 | 0.40 | Em-1 | 51 | 212 | Em-15 | 63 |
| 205 | 0.50 | Em-5 | 62 | 213 | Em-23 | 71 |
| 206 | 0.63 | Em-6 | 74 | 214 | Em-24 | 79 |
| 207 | 0.79 | Em-7 | 85 | 215 | Em-25 | 89 |
| 208 | 1.00 | Em-8 | 96 | 216 | Em-26 | 100 |

Note
*Sensitivity/granularity is expressed in a relative value, assuming that of sample 216 as 100.

As apparent from Table 5, similarly to the results of item (2) above, the tabular emulsion having principal planes composed of {100} faces exhibits a high ratio of sensitivity/granularity and thus is excellent as compared with the conventional tabular emulsion having principal planes composed of {111} faces, this being conspicuous in a small-size region of 0.6 μm or less.

The small-size silver halide emulsion of the present invention and the silver halide photographic lightsensitive material using the same are characterized in that these are excellent in the ratio of sensitivity/granularity, exhibit hard gradation and are also excellent in the latent image preservability.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A monodispersed sliver halide emulsion having an average silver iodide content of 1 to 10 mol % and an average equivalent sphere diameter of 0.1 to 0.5 $\mu$m, wherein 60% or more of the total projected area of all the grains in the emulsion are occupied by tabular silver halide grains each having principal planes composed of {100} faces, wherein the total area of the principal planes of each grain accounts for 80% or more of the total surface area of each grain, and wherein the average chloride ion ($Cl^-$) content is 0 to 10 mol %.

2. The emulsion according to claim 1, wherein the emulsion was prepared in the presence of a compound $A^0$ and/or compound $B^0$, wherein the compound $A^0$ is an organic compound constructed of a molecule and covalently bonded at least two residual groups of adsorbent thereto, wherein the adsorbent is capable of promoting formation of {100} faces in each silver halide grain, the compound $B^0$ is an organic compound having at least two alcoholic hydroxy groups per molecule, and the compound $A^0$ and compound $B^0$ are organic compounds other than gelatin and protein.

3. The emulsion according to claim 2, wherein the compound $B^0$ is a carbohydrate.

4. The emulsion according to claim 2, wherein both compound $A^0$ and compound $B^0$ are present.

5. The emulsion according to claim 1, wherein the emulsion was prepared by adding an oxidizer at any time from the initiation of grain formation to immediately before coating.

6. The emulsion according to claim 1, wherein the emulsion was prepared by adding a reducing agent at any time from the initiation of grain formation to immediately before coating.

7. The emulsion according to claim 6, wherein the reducing agent is selected from the group consisting of borane compounds, hydrazine derivatives, silane compounds, polyamines, sulfites, amines, formamidinesulfinic acid, ascorbic acid derivatives, hydroquinone derivatives, thiourea dioxides, stannous chloride, alkynylamines, reducing sugars and aminoboranes.

8. The emulsion according to claim 1, wherein the emulsion was gold-sulfur-selenium sensitized.

9. The emulsion according to claim 1, wherein the emulsion was spectrally sensitized.

10. A silver halide color photographic lightsensitive material comprising a support and at least one lightsensitive layer provided thereon, wherein the lightsensitive layer contains the emulsion according to claim 1.

11. The lightsensitive material according to claim 10, wherein the lightsensitive material is a silver halide color reversal photographic lightsensitive material.

12. The emulsion according to claim 1, wherein the total area of the principal planes of each grain accounts for 90% or more of the total surface area of each grain.

* * * * *